US010286659B2

(12) United States Patent
Ogura et al.

(10) Patent No.: US 10,286,659 B2
(45) Date of Patent: May 14, 2019

(54) INKJET PRINTER

(71) Applicant: Roland DG Corporation, Hamamatsu-shi, Shizuoka (JP)

(72) Inventors: Yoshinari Ogura, Hamamatsu (JP); Katsuo Ikehata, Hamamatsu (JP); Yuya Nishihara, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/974,737

(22) Filed: May 9, 2018

(65) Prior Publication Data

US 2018/0326722 A1 Nov. 15, 2018

(30) Foreign Application Priority Data

May 10, 2017 (JP) ..... 2017-094124

(51) Int. Cl.

| | |
|---|---|
| ***B41J 2/02*** | (2006.01) |
| ***B41J 2/07*** | (2006.01) |
| ***B41J 21/14*** | (2006.01) |
| ***B41J 2/21*** | (2006.01) |
| ***B41J 29/38*** | (2006.01) |
| ***B41J 2/14*** | (2006.01) |

(52) U.S. Cl.

CPC . *B41J 2/14* (2013.01); *B41J 2/02* (2013.01); *B41J 2/07* (2013.01); *B41J 2/2132* (2013.01); *B41J 2/2135* (2013.01); *B41J 29/38* (2013.01); *B41J 2002/022* (2013.01)

(58) Field of Classification Search

CPC ..... B41J 2/14; B41J 2/02; B41J 2/07; B41J 2/2132; B41J 2/2135; B41J 2/355; B41J 29/38; B41J 2002/022

USPC ..... 347/19, 47

See application file for complete search history.

(56) References Cited

U.S. PATENT DOCUMENTS

| | | | | |
|---|---|---|---|---|
| 6,145,960 | A | 11/2000 | Kanda et al. | |
| 6,241,338 | B1 * | 6/2001 | Otsuki | B41J 2/2132 347/41 |
| 2006/0227194 | A1 | 10/2006 | Hoshino | |
| 2006/0274101 | A1 * | 12/2006 | Oh | B41J 2/205 347/15 |
| 2009/0220695 | A1 | 9/2009 | Oyanagi et al. | |

(Continued)

FOREIGN PATENT DOCUMENTS

| | | | |
|---|---|---|---|
| JP | 10-86353 | A | 4/1998 |
| JP | 11-138787 | A | 5/1999 |

(Continued)

*Primary Examiner* — Huan H Tran
*Assistant Examiner* — Alexander D Shenderov
(74) *Attorney, Agent, or Firm* — Keating & Bennett, LLP

(57) ABSTRACT

An inkjet printer includes an m number of data setters ranging from a first data setter to an m-th data setter, and an m number of print controllers ranging from a first print controller to an m-th print controller, where m is a natural number greater than or equal to 2. Upon receiving data for ink dots, an n-th data setter sets an n-th dot group including some or all of the ink dots, where n is a natural number in a range of from 2 to m. An n-th print controller causes the n-th dot group to be formed over an (n−1) dot group. The first to the m-th data setters set the first to the m-th dot groups so that at least some of ink dots belonging to the first to the m-th dot groups overlap each other.

14 Claims, 13 Drawing Sheets

(56) References Cited

U.S. PATENT DOCUMENTS

| | | | | |
|---|---|---|---|---|
| 2012/0200633 | A1 | 8/2012 | Aoyama | |
| 2013/0201238 | A1 | 8/2013 | Tanaka et al. | |
| 2016/0229178 | A1* | 8/2016 | Fukazawa | B41J 2/2132 |
| 2016/0243848 | A1* | 8/2016 | Komamiya | G06K 15/1848 |

FOREIGN PATENT DOCUMENTS

| | | | |
|---|---|---|---|
| JP | 2002-036517 | A | 2/2002 |
| JP | 2004-017526 | A | 1/2004 |
| JP | 2006-289722 | A | 10/2006 |
| JP | 2009-113284 | A | 5/2009 |
| JP | 2009-269397 | A | 11/2009 |
| JP | 2010-240934 | A | 10/2010 |
| JP | 2012-162002 | A | 8/2012 |
| JP | 2013-156772 | A | 8/2013 |
| JP | 2013-159017 | A | 8/2013 |
| JP | 2013-252640 | A | 12/2013 |
| JP | 2013-256045 | A | 12/2013 |
| JP | 2016-127479 | A | 7/2016 |

* cited by examiner

FIG.11

PRINT MODE

☐ NORMAL PRINT MODE

☑ HIGH-DENSITY PRINT MODE

Tb

CONDITION TABLE (%)

| | FIRST INK HEAD | SECOND INK HEAD | THIRD INK HEAD | FOURTH INK HEAD |
|---|---|---|---|---|
| FIRST PRINT COVERAGE | 40 | 70 | 60 | 80 |
| SECOND PRINT COVERAGE | 40 | 30 | 60 | 20 |
| THIRD PRINT COVERAGE | 40 | 30 | 20 | 50 |
| TOTAL | 120 | 130 | 140 | 150 |

Bx

INKJET PRINTER

CROSS REFERENCE TO RELATED APPLICATIONS

This application claims the benefit of priority to Japanese Patent Application No. 2017-094124 filed on May 10, 2017. The entire contents of this application are hereby incorporated herein by reference.

BACKGROUND OF THE INVENTION

1. Field of the Invention

The present invention relates to inkjet printers.

2. Description of the Related Art

An inkjet printer equipped with a heating means for drying the ink ejected onto a recording medium is well known. For example, JP 1998-086353 A discloses an inkjet printer that carries out pre-heating, mid-printing heating, and post-heating with a single heating means. As disclosed in JP 1998-086353 A, a problem with inkjet printers has been in the way drying of the ink ejected on a recording medium should be facilitated to fix the ink onto the recording medium. The introduction of the heating means that facilitates drying of ink by heating the recording medium is one example of the way to solve the above problem.

Naturally, in inkjet printers, more problems associated with drying and fixing of ink arise when the amount of ink to be landed on the recording medium is greater. Even with such an inkjet printer equipped with a heating means as described in JP 1998-086353 A, drying of the ink is not quick enough when the amount of ink to be landed on the recording medium. Consequently, an ink dot that has not been dried sufficiently is overlaid with a next droplet of ink, causing various problems such as ink feathering. Meanwhile, demands for higher print density have been increasing. In certain circumstances, it may be attempted to form a plurality of ink dots at the same spot on the recording medium in a multilayered manner beyond the resolution of the inkjet printer. When attempting such high-density printing, drying of ink is a major problem.

SUMMARY OF THE INVENTION

In view of the foregoing, preferred embodiments of the present invention provide inkjet printers that make it possible to produce high-quality image in high-density printing.

An inkjet printer according to a preferred embodiment of the present invention includes a first ink head including a plurality of first nozzles arrayed along a sub-scanning direction and ejecting a first ink onto a recording medium, and a controller controlling the first ink head to form ink dots of the first ink on the recording medium. The controller is configured or programmed to include an m number of data setters ranging from a first data setter to an m-th data setter, where m is a natural number equal to or greater than 2, and the m number of print controllers ranging from a first print controller to an m-th print controller. Upon receiving data for the ink dots of the first ink, the first data setter sets a first dot group including some or all of the ink dots of the first ink. Upon receiving the data for the ink dots of the first ink, an n-th data setter sets an n-th dot group including some or all of the ink dots of the first ink, where n is a natural number in a range of from 2 to m. The first print controller controls the first ink head to form the first dot group on the recording medium. The n-th print controller controls the first ink head to form the n-th dot group over an (n−1) dot group. The first to the m-th data setters set the first to the m-th dot groups so that at least some of ink dots belonging to the first to the m-th dot groups overlap each other.

The above-described inkjet printer achieves high-density printing by overlapping at least some of ink dots each other. As a result, it is possible to produce high-quality images in high-density printing as well by controlling drying conditions of ink. The above-described inkjet printer ejects ink on one region of a recording medium the m number of times separately. It controls the amount of ink to be ejected at each time of ejection to control drying conditions of ink. In other words, by ejecting the ink a plurality of separate times, the above-described inkjet printer adjusts the amount of ink ejected at each time of ink ejection to an appropriate amount that allows the ink to dry by the time of next ink ejection. Thus, the just-described inkjet printer makes it possible to manage drying conditions of ink appropriately. This makes it possible to produce high-quality images with less ink feathering or the like also by high-density printing.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 11 is a view illustrating an example of an operation panel screen according to the third preferred embodiment of the present invention.

DETAILED DESCRIPTION OF THE PREFERRED EMBODIMENTS

Figure 1:
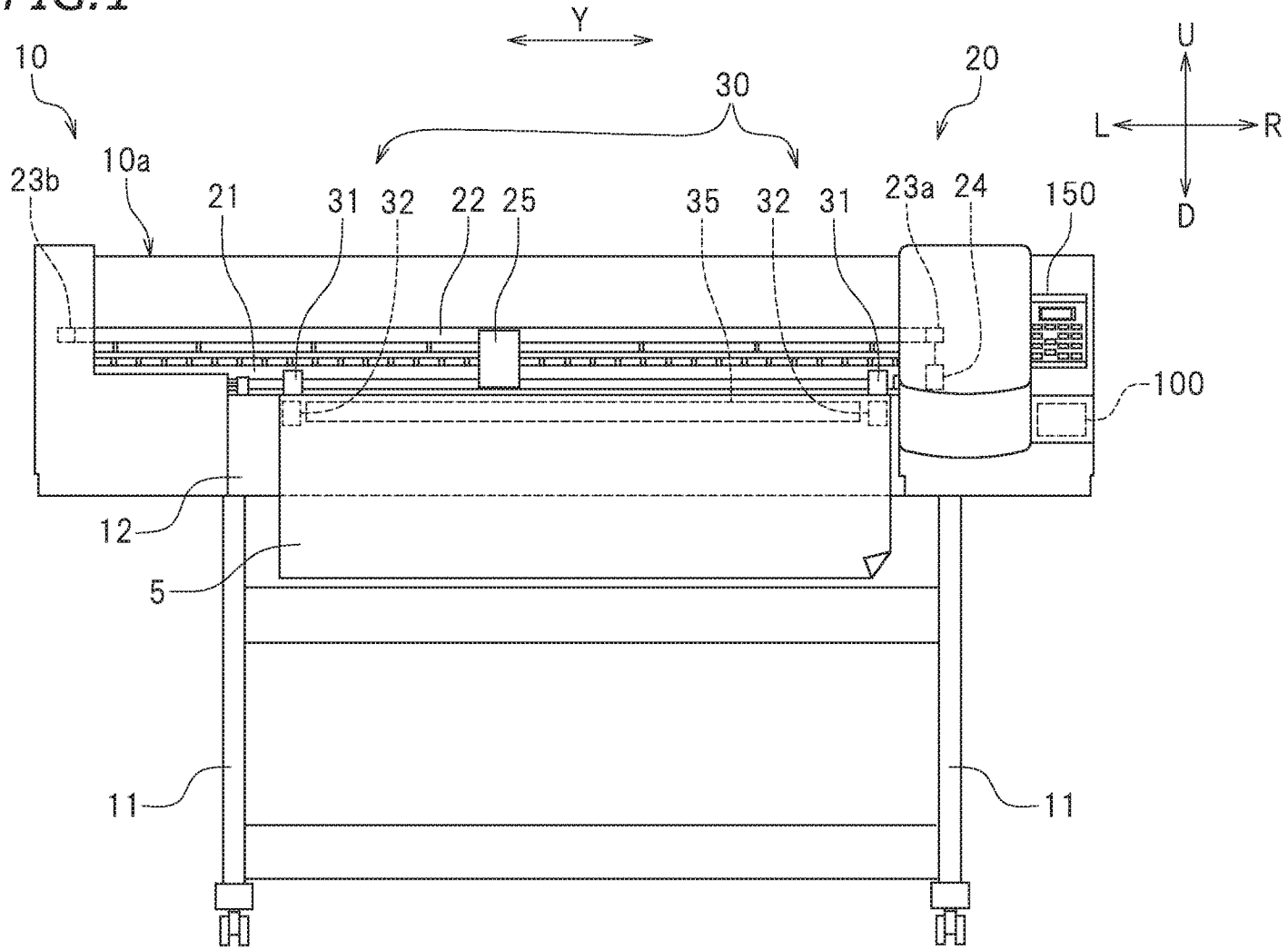
FIG. 1 is a front view illustrating an inkjet printer according to a first preferred embodiment of the present invention.

Hereinbelow, inkjet printers according to some preferred embodiments of the present invention will be described with reference to the drawings. It should be noted, however, that the preferred embodiments described herein are, of course, not intended to limit the present invention. The features and components that exhibit the same effects are denoted by the same reference symbols, and repetitive description thereof may be omitted as appropriate. In the following description, with respect to the user standing in front of the inkjet printer, a direction toward the user relative to the inkjet printer is defined as "frontward", and a direction away from the user relative to the inkjet printer is defined as "rearward". In the drawings, reference character Y represents the main scanning direction, and reference character X represents the sub-scanning direction X that is orthogonal to the main scanning direction Y. Reference characters F, Rr, L, R, U, and D in the drawings represent front, rear, left, right, up, and down, respectively. These directional terms are, however, merely provided for convenience in description, and are not intended to limit in any way the manner in which the inkjet printer should be arranged.

First Preferred Embodiment

Figure 2:
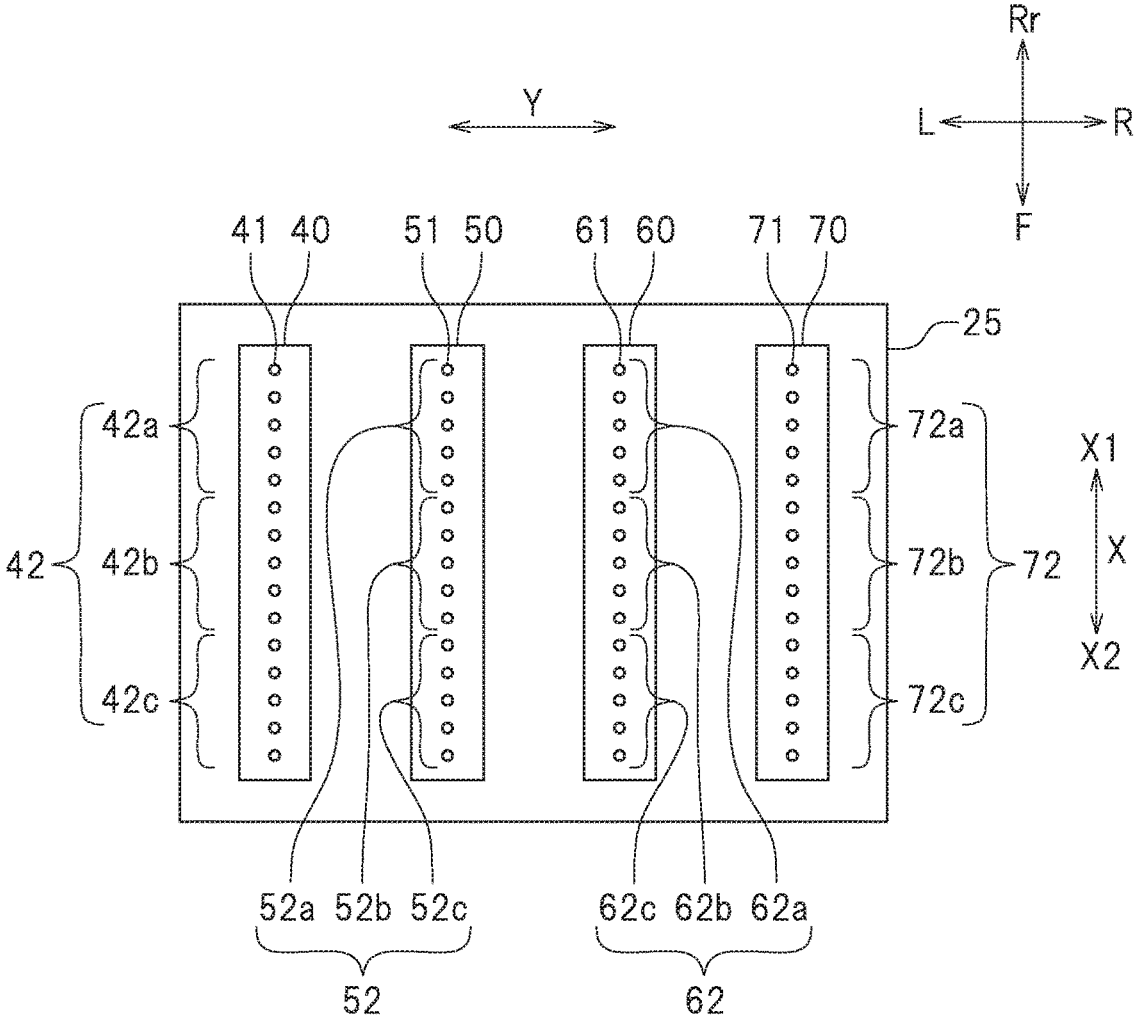
FIG. 2 is a view illustrating the configuration of the bottom surface of a carriage.

FIG. 1 is a front view of a large-format inkjet printer (hereinafter simply "printer") 10 according to a first preferred embodiment of the present invention. The printer 10 prints images on a recording medium 5 by consecutively moving a recording medium 5 in a roll form frontward (i.e., toward downstream X2 along the sub-scanning direction X) and ejecting ink from a first ink head 40, a second ink head 50, a third ink head 60, and fourth ink head 70 (all of which are shown in FIG. 2), which are mounted on a carriage 25 that moves along the main scanning direction Y. Insofar as the printer 10 herein is concerned, the directional term "downstream X2" means "frontward", and the directional term "upstream X1" means "rearward", as appropriate.

The recording medium 5 is an object on which images are to be printed. The recording medium 5 is not limited to a particular material. The recording medium 5 may be paper, such as plain paper or inkjet printing paper. The recording medium 5 may also be a transparent sheet made of such a material as resin or glass. The recording medium 5 may also be a sheet made of such a material as metal or rubber.

As illustrated in FIG. 1, the printer 10 includes a printer main body 10*a* and legs 11 that supports the printer main body 10*a*. The printer main body 10*a* extends along the main scanning direction Y. The printer main body 10*a* includes a guide rail 21 and a carriage 25 engaged with the guide rail 21. The guide rail 21 extends along the main scanning direction Y. The guide rail 21 guides movement of the carriage 25 along the main scanning direction Y. An endless belt 22 is secured to the carriage 25. The belt 22 is wrapped around a pulley 23*a*, which is disposed near the right end of the guide rail 21, and a pulley 23*b*, which is disposed near the left end of the guide rail 21. A carriage motor 24 is fitted to the right-side pulley 23*a*. The carriage motor 24 is electrically connected to a controller 100. The carriage motor 24 is controlled by the controller 100. Driven by the carriage motor 24, the pulley 23*a* rotates, and the belt 22 runs accordingly. This causes the carriage 25 to move in a main scanning direction Y along the guide rail 21. Thus, as the carriage 25 moves in a main scanning direction Y, the ink heads 40 to 70 accordingly move in the main scanning direction Y. In the present preferred embodiment, the belt 22, the pulley 23*a*, the pulley 23*b*, and the carriage motor 24 together constitute an example of a main-scanning-direction transfer device 20 that moves the carriage 25 and the ink heads 40 to 70, mounted on the carriage 25, along the main scanning direction Y.

A platen 12 is disposed below the carriage 25. The platen 12 extends along the main scanning direction Y. The recording medium 5 is to be placed on the platen 12. Pinch rollers 31 that press the recording medium 5 downward from above are provided above the platen 12. The pinch rollers 31 are disposed rearward relative to the carriage 25. The platen 12 is provided with grit rollers 32. The grit rollers 32 are disposed below the pinch rollers 31. The grit rollers 32 are provided at positions that face the pinch rollers 31. The grit rollers 32 are connected to a feed motor 33 (see FIG. 3). The grit rollers 32 are rotatable by receiving the driving force from the feed motor 33. The feed motor 33 is electrically connected to the controller 100. The feed motor 33 is controlled by the controller 100. As the grit rollers 32 rotate with the recording medium 5 being pinched between the pinch rollers 31 and the grit rollers 32, the recording medium 5 is delivered in a sub-scanning direction X. In the present preferred embodiment, the pinch rollers 31, the grit rollers 32, and the feed motor 33 are an example of a sub-scanning-direction transfer device 30 that moves the recording medium 5 along the sub-scanning direction X.

FIG. 2 is a schematic view illustrating the configuration of the surface of the carriage 25 that faces the recording medium 5 (the bottom surface thereof in the present preferred embodiment). As illustrated in FIG. 2, the first ink head 40, the second ink head 50, the third ink head 60, and the fourth ink head 70 are held in the bottom surface of the carriage 25. In the carriage 25, the first ink head 40 to the fourth ink head 70 are arrayed along the main scanning direction Y.

Each of the four ink heads, the first ink head 40 to the fourth ink head 70, ejects a process color ink to produce color images. In the present preferred embodiment, the first ink head 40 ejects cyan ink. The second ink head 50 ejects magenta ink. The third ink head 60 ejects yellow ink. The fourth ink head 70 ejects black ink. It should be noted that the number of the ink heads is not limited to 4. Moreover, the color tone of each of the process color inks used herein is not limited to any particular color tone.

As illustrated in FIG. 2, each of plurality of ink heads 40, 50, 60, and 70 includes a plurality of nozzles arrayed along the sub-scanning direction X. The plurality of nozzles in each of the ink heads are arrayed in a line along the sub-scanning direction X so as to define a nozzle array. More specifically, the first ink head 40 includes a plurality of nozzles 41 arrayed along the sub-scanning direction X, and the plurality of nozzles 41 define a nozzle array 42. The second ink head 50 includes a plurality of nozzles 51 arrayed along the sub-scanning direction X, and the plurality of nozzles 51 define a nozzle array 52. The third ink head 60 includes a plurality of nozzles 61 arrayed along the sub-scanning direction X, and the plurality of nozzles 61 define a nozzle array 62. The fourth ink head 70 includes a plurality of nozzles 71 arrayed along the sub-scanning direction X, and the plurality of nozzles 71 define a nozzle array 72. Although FIG. 2 shows that each of the ink heads 40 to 70 includes only 15 nozzles, it should be noted that each one of actual ink heads includes a far larger number of nozzles (for example, 300 nozzles). The number of the nozzles is, however, not limited to any particular number.

Each of the nozzle arrays 42 to 72 of the ink heads 40 to 70 is divided into a plurality of partial nozzle arrays arrayed along the sub-scanning direction X. In the first ink head 40, the nozzle array 42 is divided into three partial nozzle arrays

42*a*, 42*b*, and 42*c*. In the following, the partial nozzle array indicated by reference character 42*a* is referred to as a first nozzle array 42*a*, the partial nozzle array indicated by reference character 42*b* as a second nozzle array 42*b*, and the partial nozzle array indicated by reference character 42*c* as a third nozzle array 42*c*. The first nozzle array 42*a* includes five of the nozzles 41 that are disposed most upstream X1 with respect to the sub-scanning direction X. The second nozzle array 42*b* includes five of the nozzles 41 that are disposed second most upstream X1 with respect to the sub-scanning direction X, next to the five nozzles 41 belonging to the first nozzle array 42*a*. The third nozzle array 42*c* includes five nozzles of the nozzles 41 that are disposed most downstream X2 with respect to the sub-scanning direction X. Each of the first nozzle array 42*a*, the second nozzle array 42*b*, and the third nozzle array 42*c* contains the same number (5 herein) of nozzles 41. The first nozzle array 42*a*, the second nozzle array 42*b*, and the third nozzle array 42*c* have an equal or substantially equal length along the sub-scanning direction X. The rest of the ink heads, the ink heads 50 to 70, have the same nozzle array configuration as that of the first ink head 40. More specifically, in the second ink head 50, the nozzle array 52 is divided into a first nozzle array 52*a*, a second nozzle array 52*b*, and a third nozzle array 52*c*. In the third ink head 60, the nozzle array 62 is divided into a first nozzle array 62*a*, a second nozzle array 62*b*, and a third nozzle array 62*c*. In the fourth ink head 70, the nozzle array 72 is divided into a first nozzle array 72*a*, a second nozzle array 72*b*, and a third nozzle array 72*c*. All the above-mentioned nozzle arrays contain an equal number (five) of nozzles. Also, all the nozzle arrays have an equal or substantially equal length along the sub-scanning direction X. The first nozzle array 42*a* of the first ink head 40, the first nozzle array 52*a* of the second ink head 50, the first nozzle array 62*a* of the third ink head 60, and the first nozzle array 72*a* of the fourth ink head 70 are disposed at aligned positions with respect to the sub-scanning direction X. The second nozzle arrays and the third nozzle arrays are also disposed likewise.

The first ink head 40 to the fourth ink head 70 are provided with actuators (not shown) disposed therein, each of which is equipped with, for example, a piezoelectric element. The actuators are electrically connected to the controller 100. The actuators are controlled by the controller 100. By actuating the actuators, ink is ejected toward the recording medium 5 from the plurality of nozzles 41 of the first ink head 40, the plurality of nozzles 51 of the second ink head 50, the plurality of nozzles 61 of the third ink head 60, and the plurality of nozzles 71 of the fourth ink head 70.

The first ink head 40, the second ink head 50, the third ink head 60, and the fourth ink head 70 are allowed to communicate with ink cartridges (not shown) respectively by ink supply passages (not shown). The ink cartridges may be provided detachably, for example, in a right end portion of the printer main body 10*a*. The materials of the inks are not limited in any way, and it is possible to use various types of materials that have conventionally been used as the ink materials for inkjet printers. The inks may be solvent-based pigment inks or aqueous pigment inks. The inks may also be aqueous dye inks, ultraviolet curing pigment inks that cure when irradiated with ultraviolet rays, or the like.

In the present preferred embodiment, each of the nozzle arrays 42 to 72 of the ink heads 40 to 70 is divided into three partial nozzle arrays, but the number of the partial nozzle arrays per one nozzle array is not limited to 3. The number of the partial arrays in a nozzle array may be four or more, or may be two. The above-described dividing arrangement of the nozzle arrays is made merely by control operations, and it does not mean that there is a structural difference between the nozzle arrays.

As illustrated in FIG. 1, the printer 10 includes a heater 35. The heater 35 is disposed below the platen 12. The heater 35 is disposed frontward relative to the grit rollers 32. The heater 35 heats the platen 12. When the platen 12 is heated, the recording medium 5 placed on the platen 12 and the ink landed on the recording medium 5 are heated, and drying of the ink is facilitated. The heater 35 is electrically connected to the controller 100. The heating temperature of the heater 35 is controlled by the controller 100.

Figure 3:
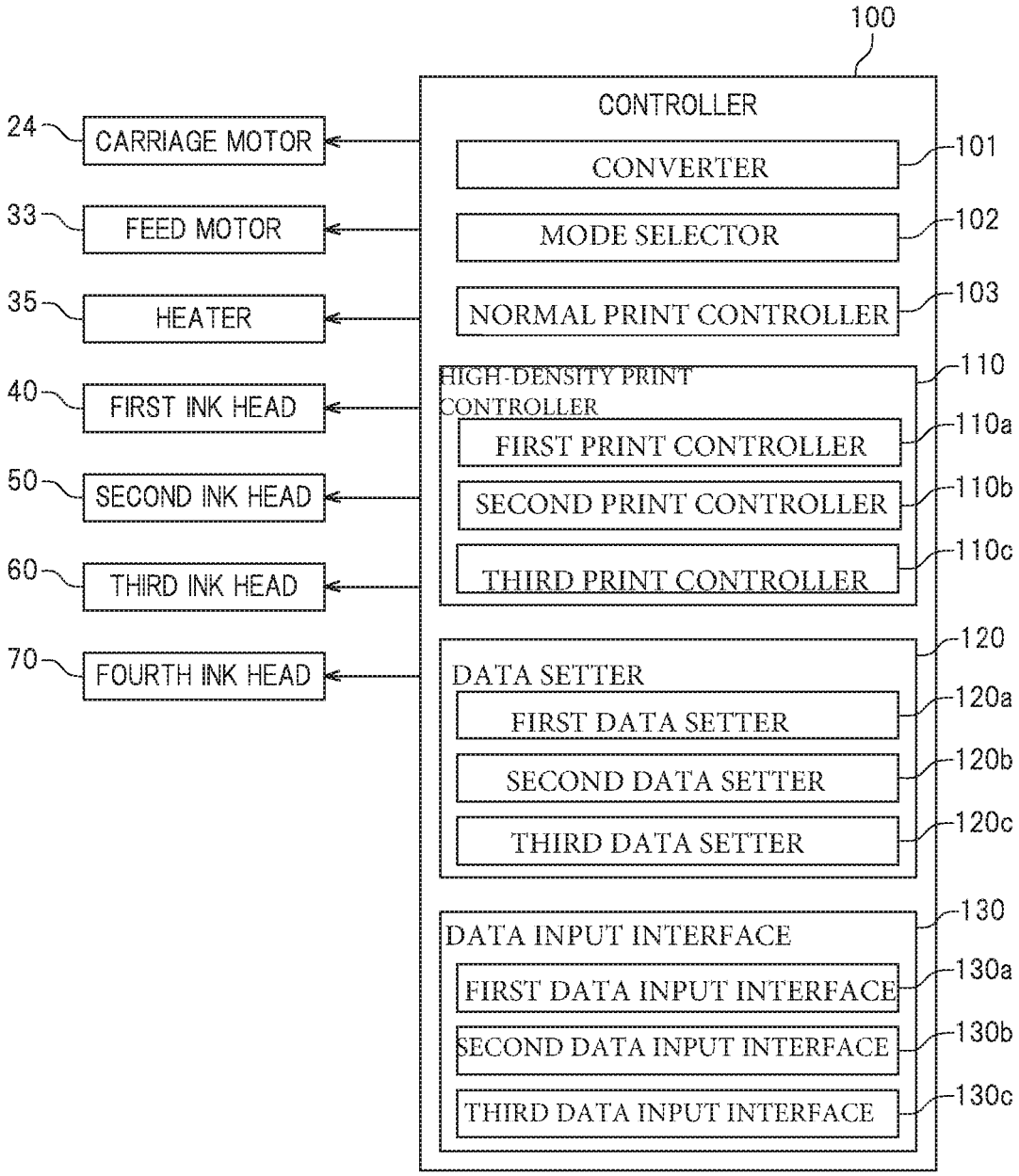
FIG. 3 is a block diagram illustrating the printer according to the first preferred embodiment of the present invention.

As illustrated in FIG. 1, an operation panel 150 is provided on a right end portion of the printer main body 10*a*. The operation panel 150 is provided with a display that displays the operating status, input keys to be operated by the user, and so forth. The controller 100 that controls various operations of the printer 10 is accommodated inside the operation panel 150. FIG. 3 is a block diagram illustrating the printer 10 according to the present preferred embodiment. As illustrated in FIG. 3, the controller 100 is communicatively connected to the feed motor 33, the carriage motor 24, the heater 35, and the ink heads 40 to 70, and the controller 100 is able to control these components. The controller 100 is configured or programmed to include a converter 101, a mode selector 102, a normal print controller 103, a high-density print controller 110, a data setter 120, and a data input interface 130.

The configuration of the controller 100 is not limited to a particular configuration. The controller 100 may be a microcomputer, for example. The hardware configuration of the microcomputer is not limited in any way. For example, the microcomputer may include an interface (I/F) that receives print data or the like from external apparatuses such as a host computer, a central processing unit (CPU) that executes control program instructions, a read only memory (ROM) that stores programs executed by the CPU, a random access memory (RAM) used as a working area to deploy the programs, and a storage, such as a memory, that stores the foregoing programs and various data. The controller 100 need not be provided inside the printer main body 10*a*. The controller 100 may be, for example, a computer that is provided external to the printer main body 10*a* and is communicatively connected to the printer main body 10*a* via a wired or wireless communication.

The converter 101 performs what is called a screening process. The screening process is a process that converts image data into patterns of ink dots. A print image produced by an inkjet printer is formed as an aggregate of ink dots of various process color inks. In the inkjet printer 10 according to the present preferred embodiment, an image is converted into ink dot patterns of four colors, cyan, magenta, yellow, and black. The converter 101 may be provided in the printer main body 10*a* or may be provided in, for example, an external computer. It should be noted that, in the following description, an aggregate of ink dots that is generated by the converter 101 is referred to as the "entire ink dot aggregate" when appropriate, and an ink dot aggregate of a specific color is referred to as the "entire ink dot aggregate of cyan ink", for example.

The mode selector 102 selects a mode of printing. In the present preferred embodiment, the print modes are categorized as a "normal print mode" and a "high-density print mode". In the normal print mode, the printer 10 forms an ink dot pattern generated by the converter 101 on the recording medium 5 as it is. The normal print mode is a mode for performing printing that is normally performed with conventionally known printers. In the high-density print mode, the printer 10 forms, on the recording medium 5, an ink dot pattern in which ink dot patterns generated by the converter 101 are partially overlapped with each other. The details of the high-density print mode will be described later. Note that, with the mode selector 102 according to the present preferred embodiment, selection of a print mode is carried out by the operator via an operation panel screen image displayed on, for example, the operation panel 150 or a display device of an external computer. However, the method of selecting a print mode is not limited thereto. For example, the print mode may be incorporated in the print data in advance. It is also possible that the print mode may be automatically selected by the mode selector 102.

The normal print controller 103 controls the printing operations in the normal print mode. The normal print controller 103 is connected to the carriage motor 24, the feed motor 33, the first ink head 40, the second ink head 50, the third ink head 60, and the fourth ink head 70, and by controlling them, the normal print controller 103 performs normal printing. The normal print controller 103 is also connected to the heater 35, and by controlling the temperature of the heater 35, it controls drying of ink after ejection.

The high-density print controller 110 controls the printing operations in the high-density print mode. The high-density print controller 110 is also connected to the carriage motor 24, the feed motor 33, the first ink head 40, the second ink head 50, the third ink head 60, the fourth ink head 70, and the heater 35, and by controlling them, the high-density print controller 110 performs high-density printing. Although the details will be described later, a plurality of print layers are printed on the recording medium 5 by overlaying the print layers on top of each other in the high-density print mode. The high-density print controller 110 is configured or programmed to include a first print controller 110*a*, a second print controller 110*b*, and a third print controller 110*c*.

The first print controller 110*a* controls printing of a first print layer in the high-density print mode. The first print layer is the lowermost one of the print layers that are formed by overlaying print layers on top of each other in the high-density print mode. The ink dots that form the first print layer are made up of a portion or all of the entire ink dot aggregate. The ink dots that form the first print layer are formed of various color inks ejected from the nozzles of the first nozzle arrays, each of which is the most upstream one of the three nozzle arrays with respect to the sub-scanning direction X in each ink head. Specifically, the first print controller 110*a* controls ejection of cyan ink from the nozzles 41 belonging to the first nozzle array 42*a* of the first ink head 40. The first print controller 110*a* also controls ejection of magenta ink from the nozzles 51 belonging to the first nozzle array 52*a* of the second ink head 50. Likewise, the first print controller 110*a* controls ejection of yellow ink from the nozzles 61 belonging to the first nozzle array 62*a* of the third ink head 60. The first print controller 110*a* also controls ejection of black ink from the nozzles 71 belonging to the first nozzle array 72*a* of the fourth ink head 70. In addition to the just-described ink ejection control, the first print controller 110*a* controls operations of the carriage motor 24 to control movements of the carriage 25. The details of the just-described control will be described later.

The second print controller 110*b* controls printing of a second print layer in the high-density print mode. The second print layer is a print layer that is formed directly above the first print layer, among the print layers that are formed by overlaying print layers on top of each other in the high-density print mode. The ink dots that form the second print layer are also made up of a portion or all of the entire ink dot aggregate. Also, the ink dots forming the second print layer are formed of various color inks ejected from the nozzles of the second nozzle arrays. The second print controller 110*b* controls ejection of cyan ink from the nozzles 41 belonging to the second nozzle array 42*b* of the first ink head 40. The second print controller 110*b* also controls ejection of magenta ink from the nozzles 51 belonging to the second nozzle array 52*b* of the second ink head 50. The second print controller 110*b* also controls ejection of yellow ink from the nozzles 61 belonging to the second nozzle array 62*b* of the third ink head 60. The second print controller 110*b* also controls ejection of black ink from the nozzles 71 belonging to the second nozzle array 72*b* of the fourth ink head 70. In addition to the just-described ink ejection control, the second print controller 110*b* controls operations of the carriage motor 24 to control movements of the carriage 25.

The third print controller 110*c* controls printing of a third print layer in the high-density print mode. The third print layer is a print layer that is formed directly above the second print layer, among the print layers that are formed by overlaying print layers on top of each other in the high-density print mode. In the present preferred embodiment, the third print layer is the topmost one of the print layers that are formed by overlaying print layers on top of each other in the high-density print mode. The ink dots that form the third print layer are also made up of a portion or all of the entire ink dot aggregate. The ink dots that form the third print layer are formed of various color inks ejected from the nozzles of the third nozzle arrays. The third print controller 110*c* controls ejection of cyan ink from the nozzles 41 belonging to the third nozzle array 42*c* of the first ink head 40. The third print controller 110*c* also controls ejection of magenta ink from the nozzles 51 belonging to the third nozzle array 52*c* of the second ink head 50. The third print controller 110*c* also controls ejection of yellow ink from the nozzles 61 belonging to the third nozzle array 62*c* of the third ink head 60. The third print controller 110*c* also controls ejection of black ink from the nozzles 71 belonging to the third nozzle array 72*c* of the fourth ink head 70. In addition to the just-described ink ejection control, the third print controller 110*c* controls operations of the carriage motor 24 to control movements of the carriage 25.

The foregoing describes that each of the first print controller 110*a* to the third print controller 110*c* controls the operations of ink heads 40 to 70 and the carriage motor 24. However, it is also possible that these components may be controlled by one or a plurality of controllers that receive instructions from the first print controller 110*a* to the third print controller 110*c*. For example, ink ejection from the ink heads may be controlled in such a manner that each of the nozzle arrays may be controlled separately. Also, the carriage motor may be controlled collectively by a single system.

Upon receiving data for the entire ink dot aggregate generated by the converter 101, the data setter 120 sets the ink dots that are caused to form by the print controllers 110*a* to 110*c*. The data setter 120 includes a first data setter 120*a*, a second data setter 120*b*, and a third data setter 120*c*. Based on the data for the entire ink dot aggregate, the first data setter 120*a* sets the ink dots that are caused to form by the first print controller 110*a*, in other words, the ink dots to be formed in the first print layer. Based on the data for the entire ink dot aggregate, the second data setter 120*b* sets the ink dots that are caused to form by the second print controller 110*b*, in other words, the ink dots to be formed in the second print layer. Based on the data for the entire ink dot aggregate, the third data setter 120*c* sets the ink dots that are caused to form by the third print controller 110*c*, in other words, the ink dots to be formed in the third print layer. The method in which the data setter 120 assigns ink dots to each of the print layers will be detailed later.

The data input interface 130 allows the operator to input a proportion of the ink dots assigned to each of the print layers by the data setter 120, with respect to the entire ink dot aggregate. The data input interface 130 displays an operation panel screen image on, for example, the operation panel 150 or a display device of an external computer. The proportion of the ink dots assigned to each of the print layers by the data setter 120 with respect to the entire ink dot aggregate is input by the operator through the just-mentioned operation panel screen image, for example. The data input interface 130 includes a first data input interface 130*a*, a second data input interface 130*b*, and a third data input interface 130*c*. The first data setter 120*a* sets the ink dots for the first print layer so that the proportion of the ink dots to be formed in the first print layer with respect to the entire ink dot aggregate becomes equal to the proportion that has been input to the first data input interface 130*a*. Likewise, the second data setter 120*b* sets the ink dots for the second print layer so that the proportion of the ink dots to be formed in the second print layer with respect to the entire ink dot aggregate becomes equal to the proportion that has been input to the second data input interface 130*b*. The third data setter 120*c* sets the ink dots for the third print layer so that the proportion of the ink dots to be formed in the third print layer with respect to the entire ink dot aggregate becomes equal to the proportion that has been input to the third data input interface 130*c*.

Printing in the normal print mode (i.e., normal printing) is carried out in the following manner. In the normal printing, the normal print controller 103 drives the carriage motor 24 so as to cause the carriage 25 to move along the main scanning direction Y and also drives the actuators to eject inks from the first ink head 40 to the fourth ink heads 70, to cause inks of various colors to land on the recording medium 5. The normal print controller 103 also controls the feed motor 33 so that the recording medium 5 is delivered consecutively frontward F (i.e., toward downstream X2 along the sub-scanning direction X). The ink on the recording medium 5 delivered by the feed motor 33 is consecutively heated and dried by the heater 35. The normal print controller 103 causes the carriage 25 to move along the main scanning direction Y one time or a plurality of times by the time the recording medium 5 is sent frontward F one time.

It should be noted that, in the normal printing described above, all the ink dots are formed individually at different positions on the recording medium 5. In other words, for the formation positions of the ink dots, only one ink dot is formed at each of the formation positions. The density of the ink dots in this condition is the density of the ink dots in the normal print mode. Although it is possible to increase the density of ink dots by increasing the resolution of image data (i.e., by reducing the pixel size), its upper limit cannot exceed the range of the resolution that can be achieved by the printer 10. When the resolution of image data is set high, the printer 10 performs printing at the set resolution in a method such as so-called multi-pass printing. However, depending on the image to be printed or depending on the type of the recording medium, it is possible that a print in which ink dots are arranged at a higher density than the resolution of the printer 10 may be desired.

For that purpose, the printer 10 according to the present preferred embodiment is provided with the mode selector 102, which allows to select a high-density print mode, and the high-density print controller 110, which control printing operations in high-density printing, so as to be able to form ink dots at a higher density than the density of the ink dots of the image data. In the high-density print mode, one region is repeatedly printed a plurality of times. In the present preferred embodiment, one region is repeatedly printed three times. An image produced by overprinting three times contains overlapping ink dots in some area. In other words, two or more ink dots are overlapped with each other at at least some of the positions where ink dots are to be formed. By overlapping two or more ink dots with each other at some of the positions where ink dots are to be formed, the printer 10 according to the present preferred embodiment achieves high-density printing. An advantage of the method of performing high-density printing by overlapping some of the ink dots, as in the present preferred embodiment, is that it does not increase the amount of required print data, as compared with the method of performing high-density printing by increasing the print resolution.

Hereinafter, the ink dot group that is formed in the first print layer, which is the lowermost layer of the print layers that are formed by repeating the overlapping printing three times, is referred to as a "first dot group". Also, the ink dot group that is formed in the second print layer, which is formed directly over the first print layer, is referred to as a "second dot group". The ink dot group that is formed in the third print layer, which is the topmost layer of the print layers that are formed by repeating the overlapping printing three times, is referred to as a "third dot group". The first dot group is set by the first data setter 120*a* based on the data for the entire ink dot aggregate. The second dot group is set by the second data setter 120*b*. The third dot group is set by the third data setter 120*c*. The first print controller 110*a* of the high-density print controller 110 controls the first ink head 40 to the fourth ink head 70 and the carriage motor 24 to form the first dot group on the recording medium 5. The second print controller 110*b* controls the first ink head 40 to the fourth ink head 70 and the carriage motor 24 to form the second dot group over the first print layer. The third print controller 110*c* controls the first ink head 40 to the fourth ink head 70 and the carriage motor 24 to further form the third dot group over the second print layer. By performing ink ejection a plurality of times separately as described above, it is possible to adjust the amount of ink ejected per one time to an appropriate amount. As a result, it is possible to produce high-quality images even in high-density printing. More specifically, even when ink is ejected repeatedly over the same locations, problems such as ink feathering are unlikely to occur because the ejection amount of the ink for the lower layer is set at an appropriate amount and therefore the ink has already been dried.

In the printer 10 of the present preferred embodiment, the ink dots for the first dot group, the second dot group, and the third dot group are formed by various color inks ejected from the nozzles in the first nozzle arrays, the nozzles in the second nozzle arrays, and the nozzles in the third nozzle arrays, respectively. In the plurality of ink heads 40 to 70, the first nozzle arrays are the nozzle arrays disposed most upstream X1 with respect to the sub-scanning direction X. In the plurality of ink heads 40 to 70, the second nozzle arrays are the nozzle arrays disposed second most upstream X1 with respect to the sub-scanning direction X, next to the first nozzle arrays. In the plurality of ink heads 40 to 70, the third nozzle arrays are the nozzle arrays disposed most downstream X2 with respect to the sub-scanning direction X. As described above, the printer 10 according to the present preferred embodiment is configured or programmed so that the order of the nozzle arrays along the sub-scanning direction X agrees with the order in which the print layers are printed, and it is able to perform high-density printing continuously.

Figure 4:
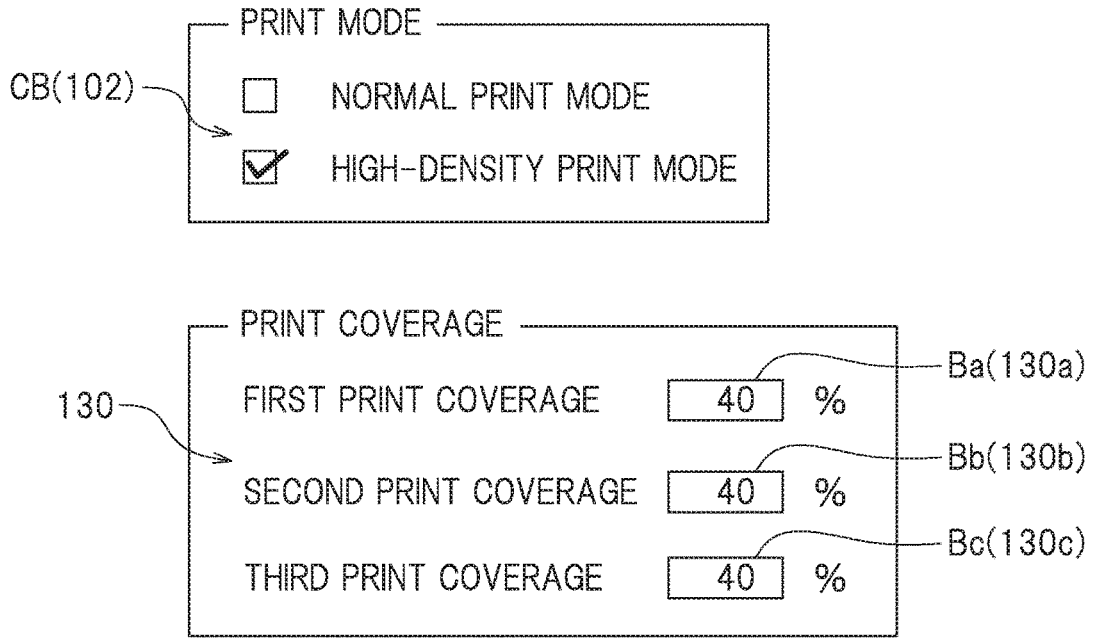
FIG. 4 is a view illustrating an example of an operation panel screen according to the first preferred embodiment of the present invention.

Hereinbelow, the process by which the printer 10 according to the present preferred embodiment performs high-density printing will be described. FIG. 4 is a view illustrating an example of an operation panel screen for the mode selector 102 and the data input interface 130. As illustrated in FIG. 4, the operation panel screen according to the present preferred embodiment includes check boxes CB enabling the operator to select a print mode. The operation panel screen also includes a first input box Ba, a second input box Bb, and a third input box Bc, which enable the operator to input a proportion of the ink dots in each print layer with respect to the entire ink dot aggregate. By checking either one of the check boxes, the check boxes CB enable the operator to select either the normal print mode or the high-density print mode. When the high-density print mode is selected, the first input box Ba to the third input box Bc are allowed to receive an input. The first input box Ba, the second input box Bb, and the third input box Bc are input interfaces displayed on the operation panel screen that are caused to be displayed by the first data input interface 130*a*, the second data input interface 130*b*, and the third data input interface 130*c*, respectively. The first input box Ba is configured to allow the operator to input a proportion of the first dot group with respect to the entire ink dot aggregate. In the operation panel screen shown in FIG. 4, the proportion of the first dot group with respect to the entire ink dot aggregate is indicated as "First Print Coverage". Likewise, the second input box Bb is configured to allow the operator to input a proportion of the second dot group with respect to the entire ink dot aggregate. In the operation panel screen shown in FIG. 4, the proportion of the second dot group with respect to the entire ink dot aggregate is indicated as "Second Print Coverage". The third input box Bc is configured to allow the operator to input a proportion of the third dot group with respect to the entire ink dot aggregate. In the operation panel screen shown in FIG. 4, the proportion of the third dot group with respect to the entire ink dot aggregate is indicated as "Third Print Coverage".

The first print coverage, the second print coverage, and the third print coverage needs to be set so that the total thereof exceeds 100%. If the total of the first print coverage, the second print coverage, and the third print coverage does not exceed 100%, the operation panel screen displays an error message and rejects the input value, for example.

Figure 5:
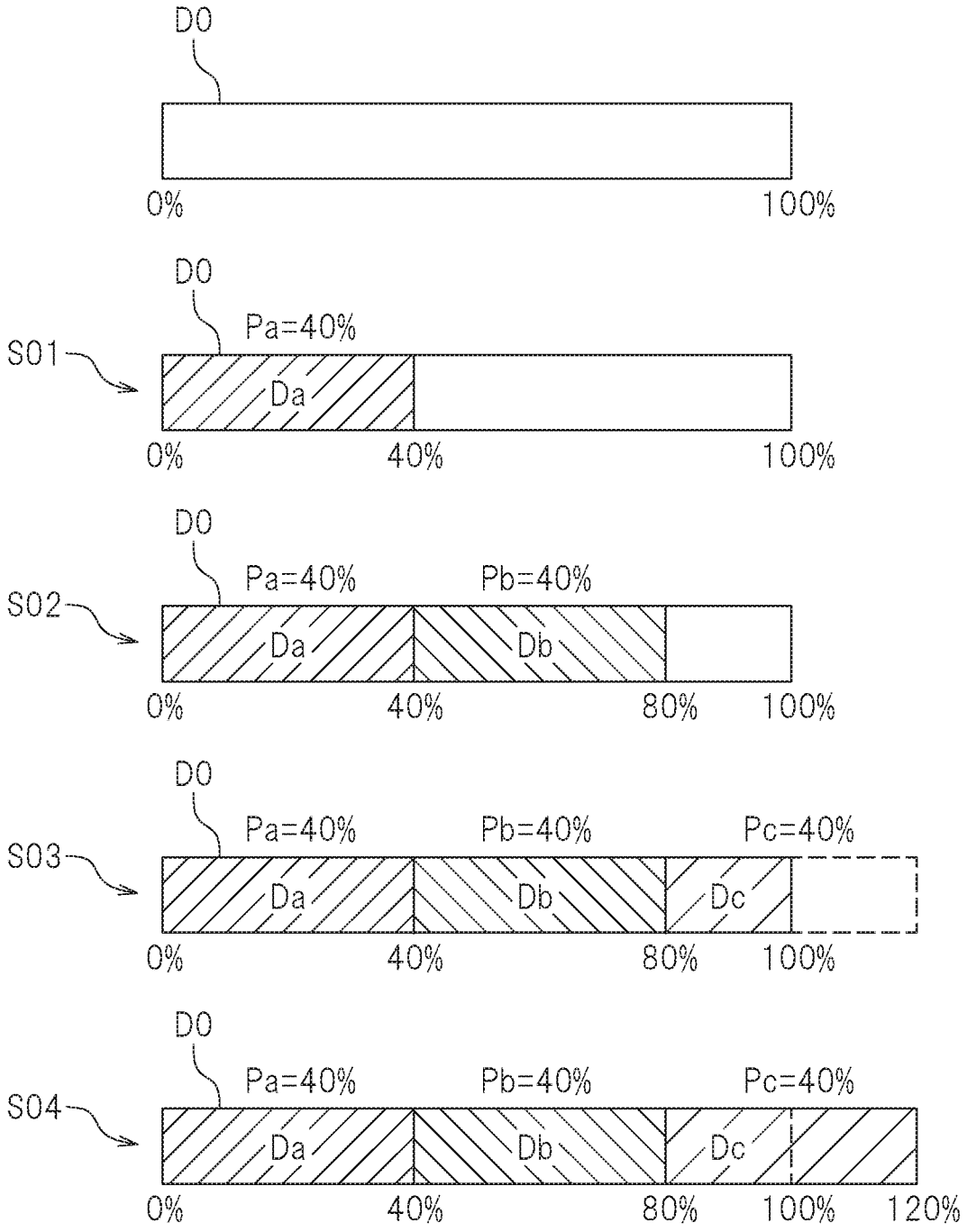
FIG. 5 is a schematic view illustrating the procedure for setting dot groups with a data setter.

After the first print coverage, the second print coverage, and the third print coverage have been input, the data setter 120 sets the first dot group, the second dot group, and the third dot group, for example, according to the following procedure. FIG. 5 is a schematic view illustrating the procedure for setting the dot groups with the data setter 120. FIG. 5 corresponds to the input values shown in the input boxes Ba to Bc of FIG. 4. Specifically, the first print coverage=about 40%, the second print coverage=about 40%, and the third print coverage=about 40% (total of about 120%), for example. Accordingly, the first dot group Da includes about 40% of the ink dots in number with respect to the entire ink dot aggregate D0, for example. The first dot group Da preferably includes about 40% of the entire ink dot aggregate of cyan ink, about 40% of the entire ink dot aggregate of magenta ink, and about 40% of the entire ink dot aggregate of yellow ink, and about 40% of the entire ink dot aggregate of black ink, for example. The second dot group Db and the third dot group Dc are also made up of the same proportions. As indicated in step S01 of FIG. 5, the first data setter 120*a* according to the present preferred embodiment extracts the first dot group Da from the entire ink dot aggregate D0 using a mask for which the first print coverage Pa (e.g., about 40% herein) is set. In other words, the mask that is set for the first data setter 120*a* has a decimation rate of about 60%, for example. The mask that is set for the first data setter 120*a* is, for example, a random mask. The first data setter 120*a* forms the first dot group Da by randomly extracting about 40% of the ink dots from the entire ink dot aggregate D0, for example. The remainder of the ink dots that is not extracted for the first dot group Da is about 60%, for example. Next, in step S02, the second data setter 120*b* sets the second dot group Db. Like the first data setter 120*a*, the second data setter 120*b* is also configured to extract the second dot group Db using a mask for which the second print coverage Pb is set. In the example shown in FIG. 4, the second print coverage Pb preferably is also about 40%. Accordingly, the second data setter 120*b* randomly extracts, as the second dot group Db, about ⅔ of the remaining about 60% of the ink dots that have not been assigned to the first dot group Da (i.e., about 40% with respect to the entire ink dot aggregate D0). The remainder of the ink dots that has neither been assigned to the first dot group Da nor to the second dot group Db is about 20%, for example. In step S03, the third data setter 120*c* extracts the remaining about 20% of the ink dots at first. However, the third print coverage is preferably about 40%, which means that the ink dots assigned to the third dot group Dc is about 40% of the entire ink dot aggregate D0, for example. Therefore, the process of step S03 still falls about 20% short. Then, in step S04, the third data setter 120*c* extracts about ¼ (i.e., about 20% with respect to the entire ink dot aggregate D0) of the ink dots from the total of the first dot group Da and the second dot group Db (i.e., about 80%) using a random mask. This about 20% of ink dots corresponds to the about 20% shortfall of ink dots in step S03.

As described above, the first dot group Da, the second dot group Db, and the third dot group Dc include "sparse" ink dots that are randomly extracted from the entire ink dot aggregate D0. Therefore, the image formed by each of the dot groups is the same as the image stored as the print data, except for the density of the ink dots. The printer 10 according to the present preferred embodiment overlaps "sparse" images on top of each other to eventually obtain a high-density image. The method of assigning ink dots to each of the dot groups is not limited to the above-described method. For example, the mask provided in each of the data setters 120*a* to 120*c* need not be a random mask, but may be a mask that uses any kind of statistical technique.

Figure 6A:
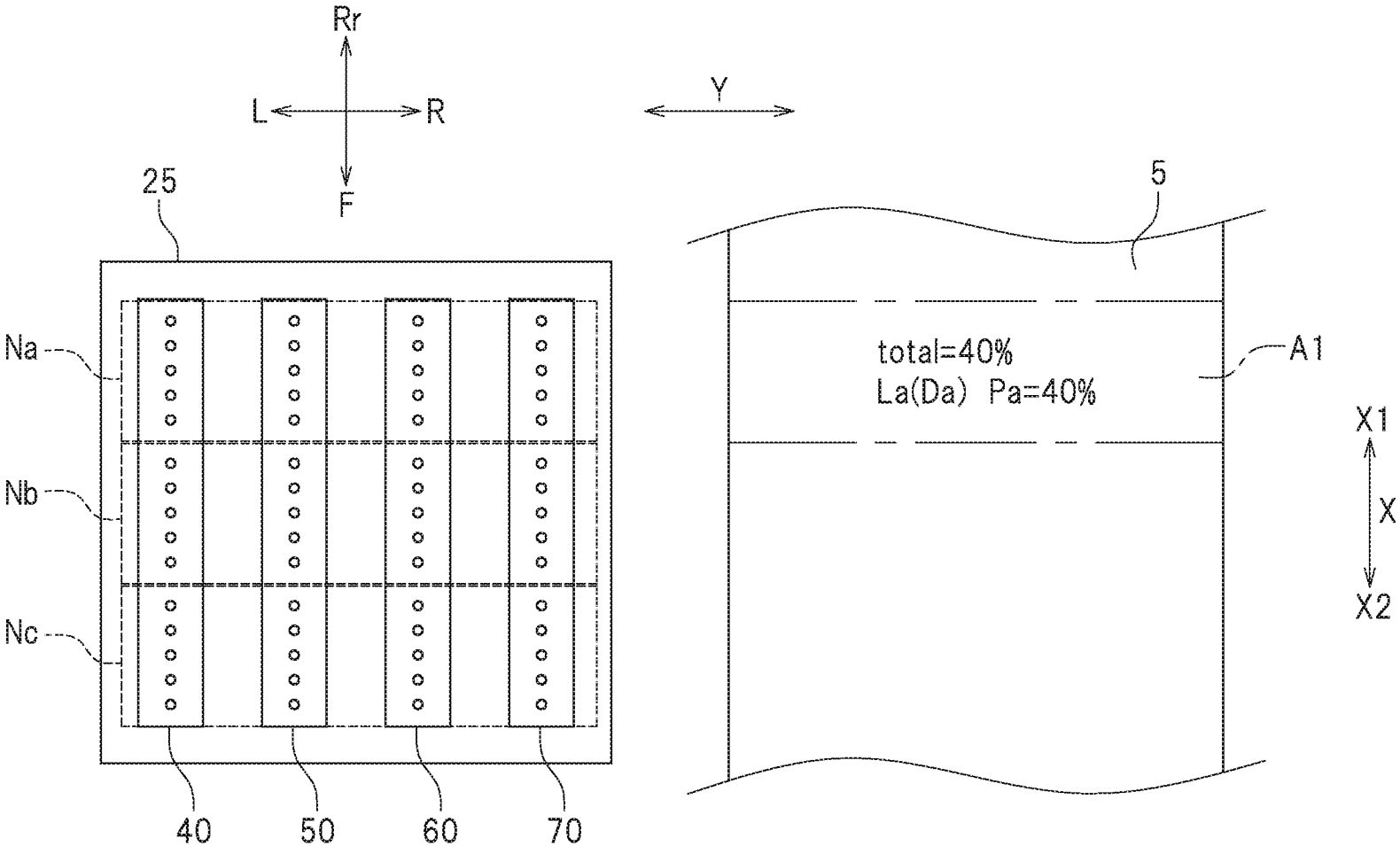
FIG. 6A is a schematic view illustrating a region on a recording medium at a certain time point during high-density printing.

After ink dots have been assigned to each of the dot groups as described above, printing on the recording medium 5 is performed. The following describes a print process that is performed in the case shown in FIG. 4. FIG. 6A is a schematic view illustrating a region on the recording medium 5 at a certain time point during high-density printing. A plan view of the carriage 25 seen from the top U is shown on the left of FIG. 6A. The recording medium 5 is shown to the right of the carriage 25. In FIG. 6A, a region of the recording medium 5 that is positioned directly above the carriage 25 is shown to the right of the carriage 25. For example, at the time point shown in FIG. 6A, the region on the recording medium 5 that is positioned directly below the first nozzle arrays Na is a region A1. The first nozzle arrays Na include the first nozzle array 42*a* of the first ink head 40, the first nozzle array 52*a* of the second ink head 50, the first nozzle array 62*a* of the third ink head 60, and the first nozzle array 72*a* of the fourth ink head 70 (see FIG. 2 for all the nozzle arrays). Referring to FIG. 6A, a first print layer La is formed on the region A1. The first print layer La is formed of ink dots of the ink ejected from the first nozzle arrays Na, that is, the first dot group Da. In the first print layer La shown in FIG. 6A, the first print coverage Pa for the first print layer La (Pa=about 40% herein) is indicated. This means that the ink dots of the first dot group Da are formed in the region A1 and that those ink dots have formed the first print layer La. In the region A1, the cumulative print coverage up to that time point (indicated as "total" in FIG. 6A) is also indicated.

Figure 6B:
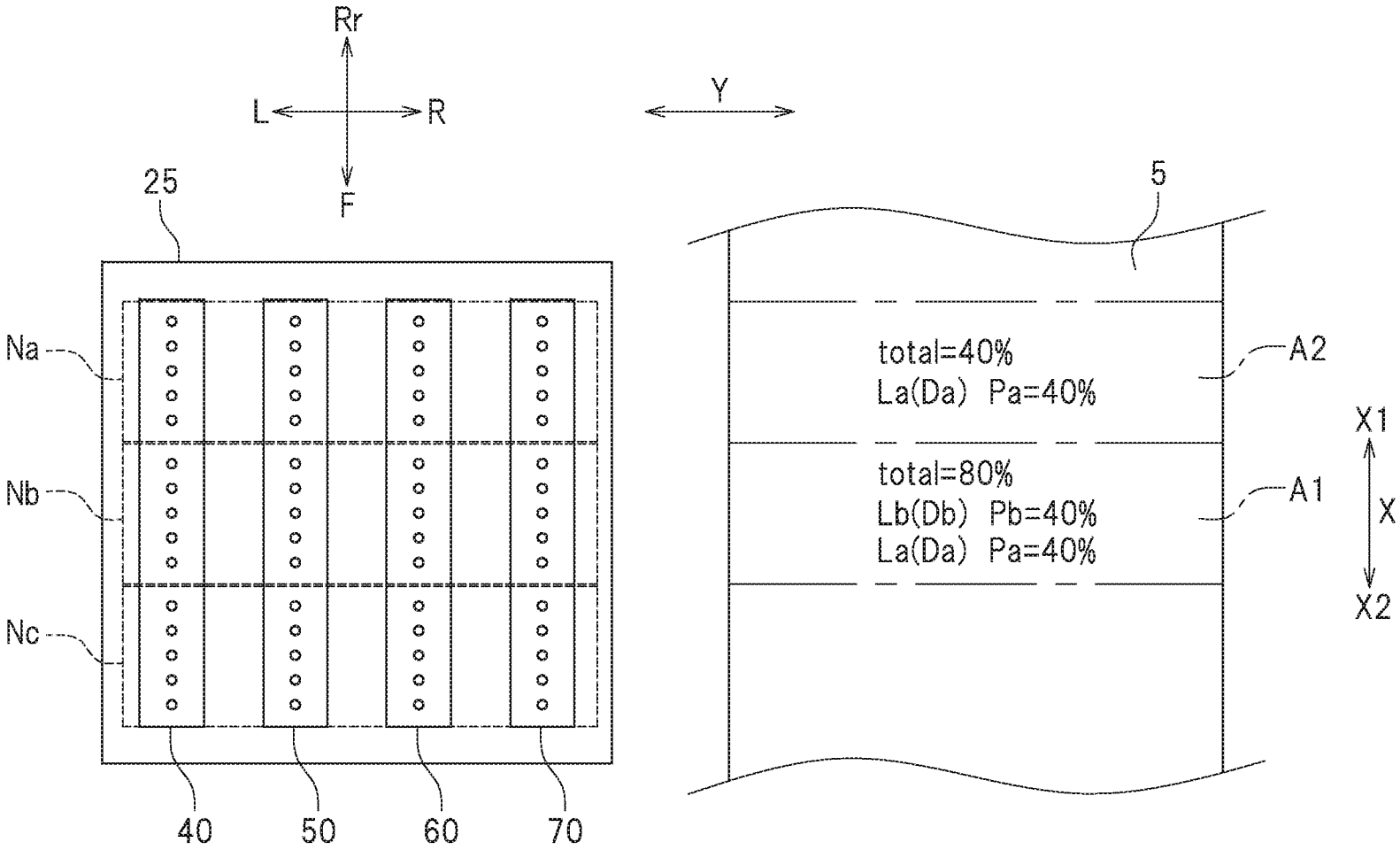
FIG. 6B is a schematic view illustrating regions on the recording medium at a next pass subsequent to the time point illustrated by FIG. 6A.

FIG. 6B is a schematic view illustrating a region on the recording medium 5 in the next pass to the time point shown in FIG. 6A. Between the time point illustrated by FIG. 6A and the time point illustrated by FIG. 6B, the second print controller 110*b* transfers the recording medium 5 one time frontward F by controlling the feed motor 33. There, the region A1 has been moved to be directly below the second nozzle arrays Nb. A region A2 that is next to the region A1 is positioned directly below the first nozzle arrays Na. In the region A1 shown in FIG. 6B, both the first print layer La (first print coverage Pa=about 40%) and the second print layer Lb (second print coverage Pb=about 40%) are indicated. The cumulative print coverage, total=about 80%, is also indicated therein. This means that, at the time point illustrated by FIG. 6B, the first print layer La and the second print layer Lb are overlapped on the region A1, and at that time point, the cumulative print coverage for the region A1 is about 80%, for example. The second print layer Lb is a print layer formed by the second dot group Db. In the region A2 shown in FIG. 6B, the first print layer La composed of the first dot group Da is also formed by the nozzles of the first nozzle arrays Na.

Figure 6C:
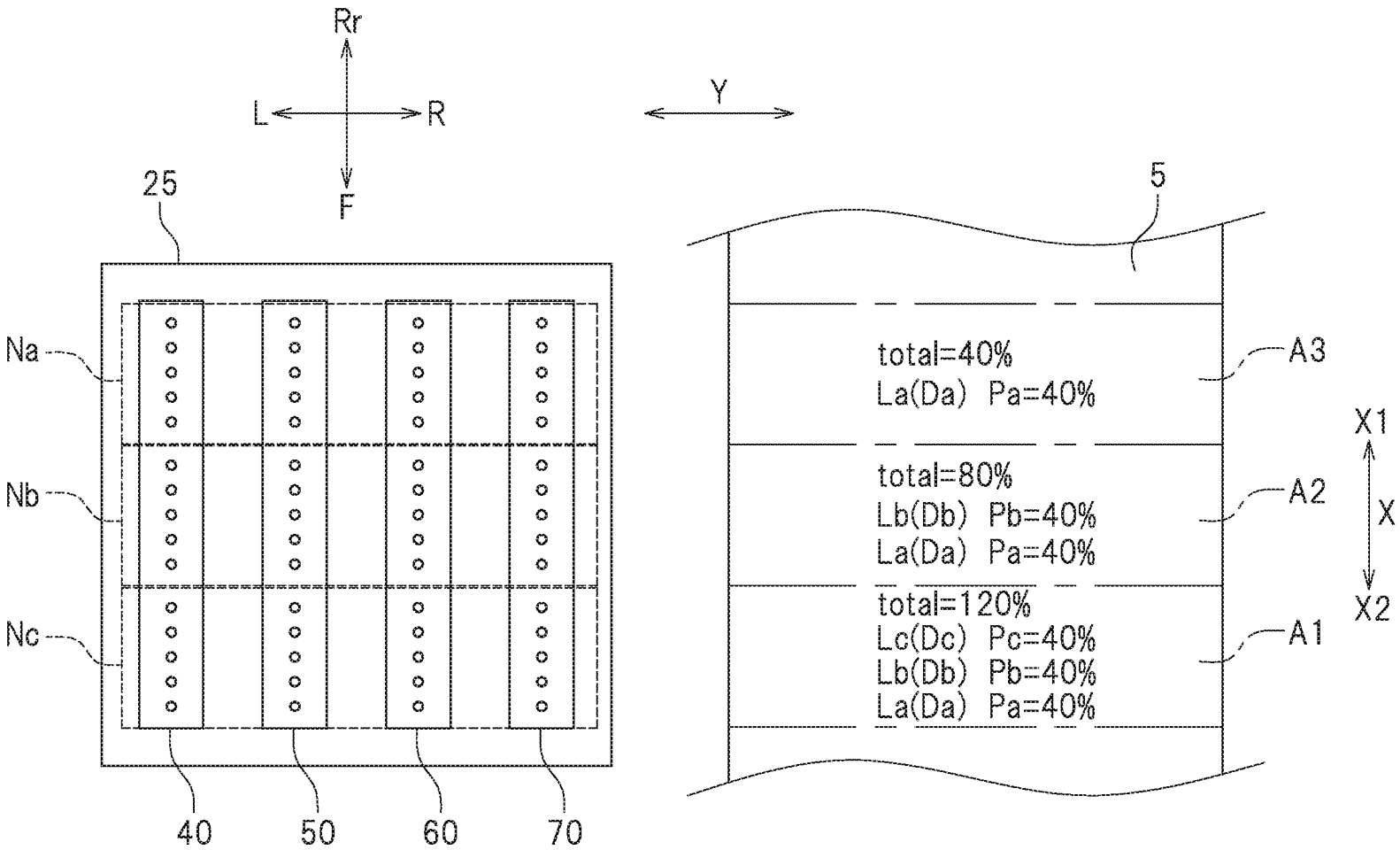
FIG. 6C is a schematic view illustrating regions on the recording medium at a next pass subsequent to the time point illustrated by FIG. 6B.

FIG. 6C is a schematic view illustrating regions on the recording medium 5 at a next pass further subsequent to the time point illustrated by FIG. 6B. Between the time point illustrated by FIG. 6B and the time point illustrated by FIG. 6C, the third print controller 110*c* transfers the recording medium 5 one time frontward F by controlling the feed motor 33. There, the region A1 has been moved to be directly below the third nozzle arrays Nc. A region A3 next to the region A2 is positioned directly below the first nozzle arrays Na. The region A2 is positioned directly below the second nozzle arrays Nb. In the region A1 shown in FIG. 6C, the first print layer La (first print coverage Pa=about 40%), the second print layer Lb (second print coverage Pb=about 40%), and the third print layer Lc (third print coverage Pc=about 40%) are indicated, and the cumulative print coverage, total=about 120%, for example, is also indicated. This means that, at the time point illustrated by FIG. 6C, the first print layer La, the second print layer Lb, and the third print layer Lc are overlapped on the region A1, and at that time point, the cumulative print coverage for the region A1 is about 120%, for example. The third print layer Lc is a print layer formed by the third dot group Dc. In addition, the first print layer La formed of the first dot group Da and the second print layer Lb formed of the second dot group Db are overlapped on the region A2 shown in FIG. 6C. The cumulative print coverage of the region A2 is about 80%, for example. On the region A3, the first print layer La, which is formed of the first dot group Da, is formed by the nozzles of the first nozzle arrays Na.

As described above, the printer 10 according to the present preferred embodiment is configured or programmed so as to perform high-density printing through the three-time overprinting that is continuously carried out. For that purpose, each of the ink heads 40, 50, 60, and 70 according to the present preferred embodiment preferably includes three partial nozzle arrays Na, Nb, and Nc, each of which has an equal number (five herein) of nozzles. In addition, the data setter 120 according to the present preferred embodiment is able to set a desired print coverage (or a desired decimation rate) for the mask. As a result, it is possible to control drying conditions for ink by way of the print coverage as described above. More specifically, by setting a print coverage such as to enable the ink to dry sufficiently by the time the next ink ejection is performed, it is possible to prevent ink feathering resulting from the overlapping of ink. As a result, it is possible to produce a high-quality image.

The high-density printing may be carried out by a multi-pass technique. For example, in the case of multi-pass printing in which an image is completed with 4 passes, a set of 4 passes corresponds to 1 scanning in single-pass printing. In that case, at the time point illustrated in FIG. 6A, the carriage 25 scans 4 times along the main scanning direction Y. By scanning in the just-described manner 4 times, the first print layer La is formed on the region A1. The following process may also be carried out in the same manner.

In the foregoing preferred embodiment, the operation panel screen is illustrated as having a design as shown in FIG. 4, but the operation panel screen is not limited thereto. For example, the setting operation may be more simplified, and only a cumulative print coverage value may be required as the input. In that case, the print coverage allocated to each of the print layers is automatically set by the data setter 120. For example, the cumulative print coverage may be divided into equal rates. Alternatively, the allocation of print coverage may be carried out according to a predetermined rule stored in the data setter 120.

For example, a preferred embodiment of automatically setting print coverages may be as follows. Assume that the operator sets the cumulative print coverage to about 120% via an input operation. Then, the data setter 120 according to this preferred embodiment allocates, for example, about 70% to the first print coverage, about 25% to the second print coverage, and about 25% to the third print coverage. That is, the print coverage for each of the dot groups that are formed later than the second dot group is set lower than the print coverage for the first dot group. In many cases, a dot group that is formed relatively later is overlapped on the locations where ink dots have already been formed. When the number of the ink dots in such an ink dot group that is formed relatively later is set smaller, problems associated with the overlapping of ink dots, such as ink feathering, may be alleviated.

Another preferred embodiment of automatically setting print coverages may be, for example, as follows. As in the above-described example, it is assumed that the operator sets the cumulative print coverage to about 120% by way of an input operation. Then, the data setter 120 according to the other preferred embodiment allocates, for example, about 60% to the first print coverage, about 20% to the second print coverage, and about 40% to the third print coverage, for example. That is, the print coverage for the second dot group is set lower than the print coverage for the first dot group. At the same time, the print coverage for each of the dot groups that are formed later than the third dot group is set lower than the print coverage for the first dot group and higher than the print coverage for the second dot group. When the amount of ink of the second dot group, which is ejected over the ink dots of the first dot group, is set lower to eliminate the problem such as feathering at that time point, the print coverage for each of the dot groups formed later than the third dot group may be set relatively freely. For this reason, the print coverage for each of the dot groups that are formed later than the third dot group is set higher than the print coverage for the second dot group.

Alternatively, it is possible that the print coverage for each of the dot groups may be set so that a high print coverage and a low print coverage are alternately assigned to the dot groups repeatedly. When the print coverage for each of the dot groups is set in this manner, high-density printing may be proceeded while ink is allowed to dry appropriately every two print layers.

Second Preferred Embodiment

A second preferred embodiment of the present invention allows the operator to specify the number of nozzle arrays allocated per ink head through an operation on the operation panel screen. In other words, a printer 10 according to the second preferred embodiment does not have a fixed number of nozzle arrays, and the operator sets the number of nozzle arrays and the print coverage for each of the nozzle arrays each time. In the second preferred embodiment, preferably at most five nozzle arrays are able to be set per each one ink head. It should be noted that the number, at most five, is merely illustrative, and the number of the nozzle arrays that can be set per one ink head is not limited to five. Note that the printer 10 according to the second preferred embodiment is preferably the same as that according to the first preferred embodiment, except for the just-described configuration. In the following description of the second preferred embodiment, the same elements as in the first preferred embodiment are designated by the same reference numerals and will not be further elaborated upon. The same applies to the later-described third preferred embodiment.

Figure 7:
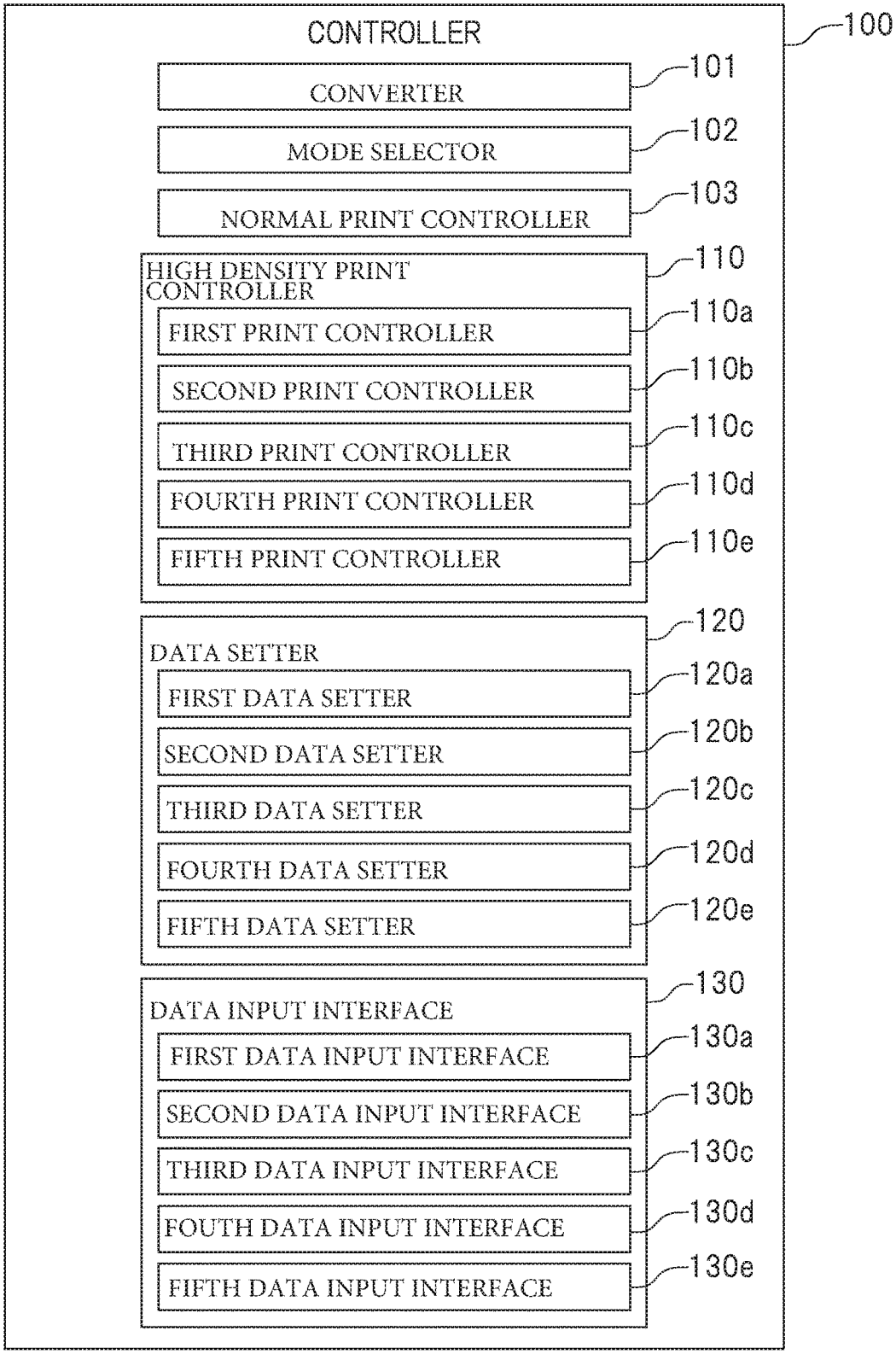
FIG. 7 is a block diagram illustrating a controller according to a second preferred embodiment of the present invention.

FIG. 7 is a block diagram illustrating the controller 100 according to the present preferred embodiment. As illustrated in FIG. 7, the high-density print controller 110 according to the present preferred embodiment includes a fourth print controller 110*d* and a fifth print controller 110*e*, in addition to the first print controller 110*a* to the third print controller 110*c*. The data setter 120 according to the present preferred embodiment also includes a fourth data setter 120*d* and a fifth data setter 120*e*, in addition to the first data setter 120*a* to the third data setter 120*c*. The data input interface 130 according to the present preferred embodiment also includes a fourth data input interface 130*d* and a fifth data input interface 130*e*, in addition to the first data input interface 130*a* to the third data input interface 130*c*.

Figure 8:
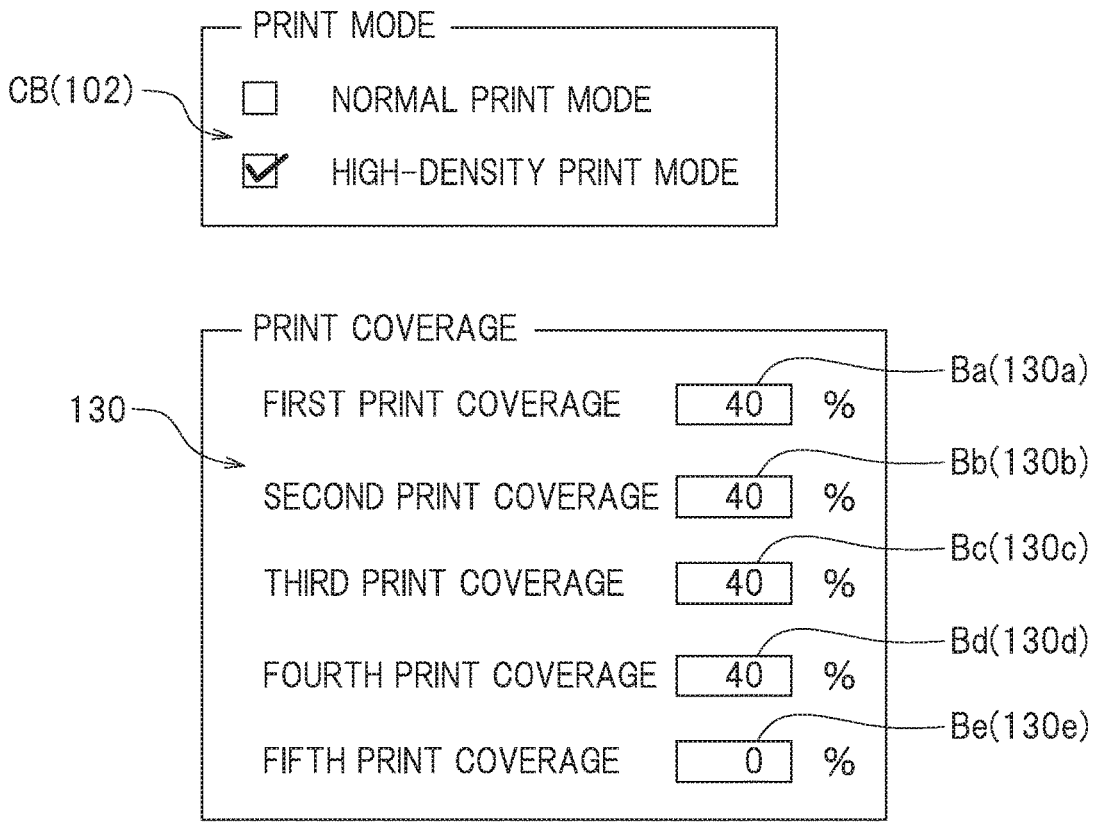
FIG. 8 is a view illustrating an example of operation panel screen images according to the second preferred embodiment of the present invention.

FIG. 8 is a schematic view illustrating an example of an operation panel screen according to the present preferred embodiment. As illustrated in FIG. 8, the operation panel screen image according to the present preferred embodiment includes five check boxes, ranging from a first input box Ba to a fifth input box Be. Like the first preferred embodiment, in the operation panel screen according to the present preferred embodiment, the input boxes Ba to Be are configured to allow the operator to input print coverage. The first input box Ba to the fifth input box Be are the first data input interfaces 130*a* to the fifth input interface 130*e*, respectively, that are displayed on the operation panel screen. In the present preferred embodiment, however, a print coverage does not need to be input into all of the first input box Ba to the fifth input box Be. Only the data input interface(s) corresponding to the input box(es) provided with a print coverage is/are enabled. For example, as illustrated in FIG. 8, when print coverages are input in the first input box Ba, the second input box Bb, the third input box Bc, and the fourth input box Bd, the first data input interface 130*a*, the second data input interface 130*b*, the third data input interface 130*c*, and the fourth data input interface 130*d* are enabled. The relationship between the data input interfaces, the data setters, and the print controllers is the same as that in the first preferred embodiment. For example, when a fourth print coverage is input to the fourth data input interface 130*d*, the fourth data setter 120*d* sets a fourth dot group based on the fourth print coverage. The ink dots belonging to the fourth dot group are formed over the third print layer by the fourth print controller 110*d*, as the ink dots that form the fourth print layer. In the example shown in FIG. 8, the fifth data input interface 130*e* does not operate because the fifth input box Be does not contain an input of print coverage.

Figure 9:
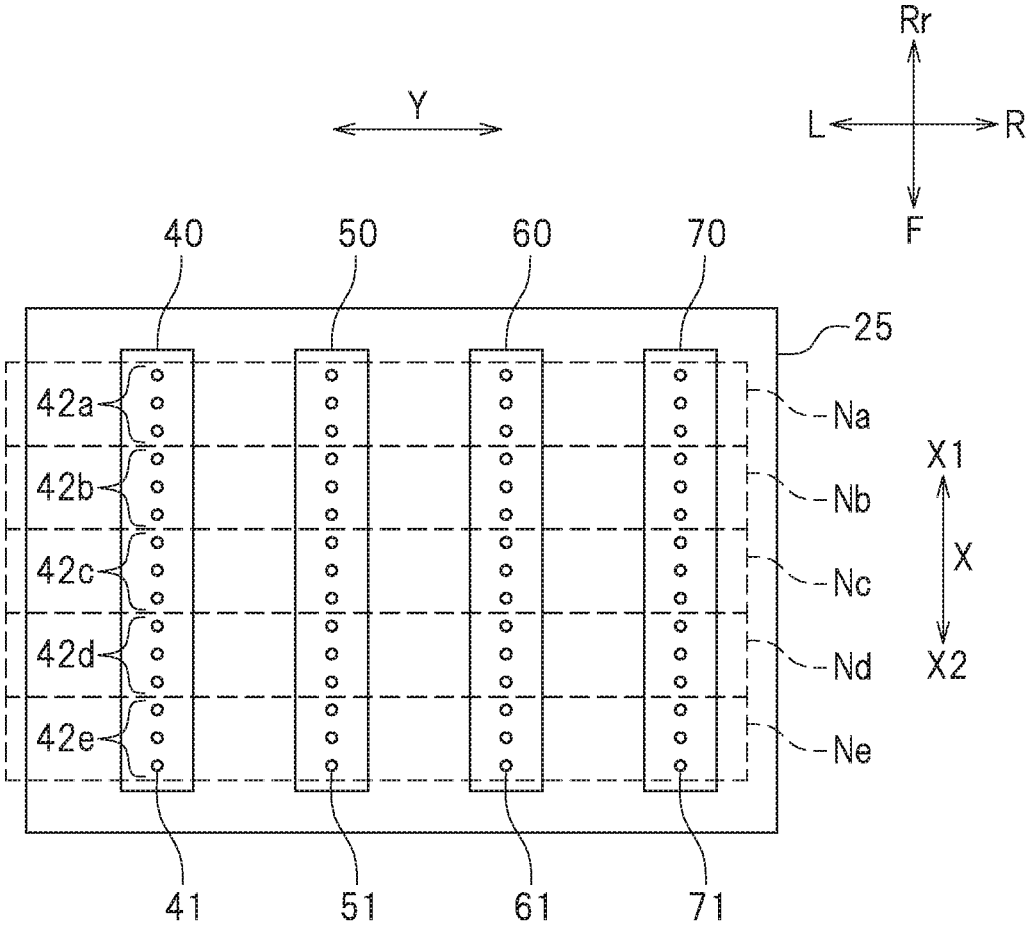
FIG. 9 is a view illustrating the configuration of the bottom surface of a carriage according to the second preferred embodiment of the present invention.

FIG. 9 is a view illustrating the configuration of the bottom surface of the carriage 25 according to the present preferred embodiment. The configuration of the bottom surface of the carriage 25 according to the present preferred embodiment is the same as that in the first preferred embodiment. More specifically, the number of the ink heads is 4, the first ink head 40 to the fourth ink head 70, and the number of the nozzles provided in each of the ink heads 40 to 70 is 15, for example. FIG. 9 illustrates an allocation of nozzle arrays that supports four-layer overprinting shown in FIG. 8. Specifically, as illustrated in FIG. 9, the nozzle array 42 of the ink head 40 is divided into a non-use nozzle array 42*e* and four partial nozzle arrays, the first nozzle array 42*a*, the second nozzle array 42*b*, the third nozzle array 42*c*, and the fourth nozzle array 42*d*. More specifically, the first nozzle array 42*a* includes three of the nozzles 41 in the nozzle array 42 that are disposed most upstream X1 with respect to the sub-scanning direction X. The second nozzle array 42*b* includes three of the nozzles 41 that are disposed upstream X1 with respect to the sub-scanning direction X, next to the first nozzle array 42*a*. The third nozzle array 42*c* includes three of the nozzles 41 that are disposed upstream X1 with respect to the sub-scanning direction X, next to the second nozzle array 42*b*. The fourth nozzle array 42*d* includes three of the nozzles 41 that are disposed upstream X1 with respect to the sub-scanning direction X, next to the third nozzle array 42*c*. The non-use nozzle array 42*e* includes three nozzles of the nozzles 41 that are disposed most downstream X2 with respect to the sub-scanning direction X. The nozzles 41 belonging to the first nozzle array 42*a* to the fourth nozzle array 42*d* eject inks that form the first print layer, the second print layer, the third print layer, and the fourth print layer, respectively, as in a similar manner to that described in the first preferred embodiment. The non-use nozzle array 42*e* is a partial nozzle array including nozzles 41 that do not eject ink. The ink heads 50, 60, and 70 also have the same arrangement of nozzle arrays.

In FIG. 9, 15 nozzles are provided per one ink head, so the nozzle utilization rate with respect to all the nozzles is about 80% (the number of nozzles used: 12=3 nozzles×4 partial nozzle arrays, with respect to the number of all nozzles: 15), for example. However, actual ink heads are provided with a far larger number of nozzles per one ink head. For example, when it is assumed that the number of nozzles per one ink head is 310, the number of nozzles 41 in each of the first nozzle array 42*a* to the fourth nozzle array 42*d* may be 77, for example. The number of nozzles 41 in the non-use nozzle array 42*e* is 2, for example. In that case, the utilization rate of nozzles 41 is about 99.4%, for example. In actual ink heads, the utilization rate of nozzles 41 is higher than about 80%, for example. Note that, in the present preferred embodiment, the non-use nozzle array 42*e* is disposed most downstream X2 with respect to the sub-scanning direction X, but the position of the non-use nozzle array 42*e* in the ink head 40 is not limited thereto. For example, in the ink head 40, the non-use nozzle array 42*e* may be provided most upstream X1 with respect to the sub-scanning direction X. Moreover, the non-use nozzles do not need to be gathered at one location. The non-use nozzles may be distributed among the nozzle arrays to be used.

With the printer 10 according to the second preferred embodiment as well, the process of high-density printing is similar to that in the first preferred embodiment. Under the conditions shown in FIG. 8, a first print layer (first print coverage=about 40%) is formed by the ink ejected from the nozzles of the first nozzle arrays Na. Over the first print layer, a second print layer (second print coverage=about 40%) is formed by the ink ejected from the nozzles of the second nozzle arrays Nb. Over the second print layer, a third print layer (third print coverage=about 40%) is formed by the ink ejected from the nozzles of the third nozzle arrays Nc. Over the third print layer, a fourth print layer (fourth print coverage=about 40%) is formed by the ink ejected from the nozzles of the fourth nozzle arrays Nd. During that time, the recording medium 5 is intermittently transferred by the sub-scanning-direction transfer device 30 toward downstream X2 along the sub-scanning direction X. The cumulative print coverage is about 160%, for example.

The printer 10 according to the present preferred embodiment allows more freedom in controlling on the drying of ink in high-density printing. Therefore, adjustment for obtaining desired print quality may be carried out more easily. As a result, higher print quality is achieved.

Third Preferred Embodiment

A third preferred embodiment of the present invention allows an independent print coverage to be set for each of a plurality of ink heads. A printer 10 according to the present preferred embodiment allows each one of the ink heads to have a first print coverage to an m-th print coverage independent of the print coverages of the other ones of the ink heads.

Figure 10:
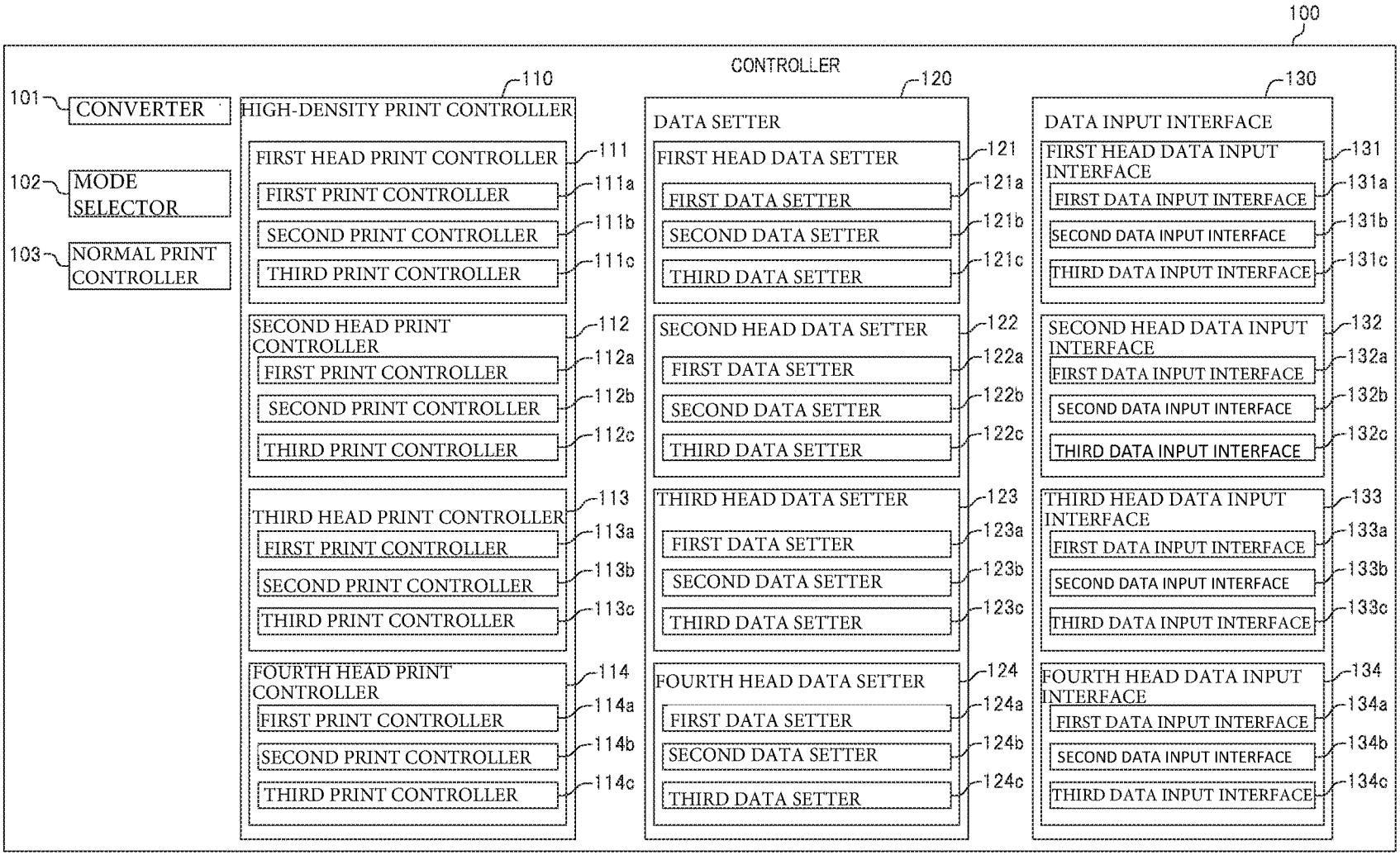
FIG. 10 is a block diagram illustrating a controller according to a third preferred embodiment of the present invention.

FIG. 10 is a block diagram illustrating the controller 100 according to the present preferred embodiment. The high-density printing performed by the printer 10 according to the present preferred embodiment is three-layer overprinting, as in the first preferred embodiment. A high-density print controller 110 according to the present preferred embodiment is configured or programmed to include a first head print controller 111, a second head print controller 112, a third head print controller 113, and a fourth head print controller 114. Each of the first to the fourth head print controllers 111 to 114 includes a first print controller, a second print controller, and a third print controller. More specifically, the first head print controller 111 includes a first print controller 111*a*, a second print controller 111*b*, and a third print controller 111*c*. The second head print controller 112 includes a first print controller 112*a*, a second print controller 112*b*, and a third print controller 112*c*. The third head print controller 113 includes a first print controller 113*a*, a second print controller 113*b*, and a third print controller 113*c*. The fourth head print controller 114 includes a first print controller 114*a*, a second print controller 114*b*, and a third print controller 114*c*. The first head print controller 111 controls operation of the first ink head 40 during high-density printing. Likewise, the second head print controller 112 controls operation of the second ink head 50 during high-density printing. The third head print controller 113 controls operation of the third ink head 60 during high-density printing. The fourth head print controller 114 controls operation of the fourth ink head 70 during high-density printing. The first print controller 111*a*, the second print controller 111*b*, and the third print controller 111*c* of the first head print controller 111 respectively control the operations to form a first print layer, a second print layer, and a third print layer with cyan ink. The first print controller 112*a*, the second print controller 112*b*, and the third print controller 112*c* of the second head print controller 112 respectively control the operations to form the first print layer, the second print layer, and the third print layer with magenta ink. The first print controller 113*a*, the second print controller 113*b*, and the third print controller 113*c* of the third head print controller 113 respectively control the operations to form the first print layer, the second print layer, and the third print layer with yellow ink. The first print controller 114*a*, the second print controller 114*b*, and the third print controller 114*c* of the fourth head print controller 114 respectively control the operations to form the first print layer, the second print layer, and the third print layer with black ink.

As illustrated in FIG. 10, a data setter 120 according to the present preferred embodiment is configured or programmed to include a first head data setter 121, a second head data setter 122, a third head data setter 123, and a fourth head data setter 124. The first head data setter 121 includes a first data setter 121*a*, a second data setter 121*b*, and a third data setter 121*c*. The second head data setter 122 includes a first data setter 122*a*, a second data setter 122*b*, and a third data setter 122*c*. The third head data setter 123 includes a first data setter 123*a*, a second data setter 123*b*, and a third data setter 123*c*. The fourth head data setter 124 includes a first data setter 124*a*, a second data setter 124*b*, and a third data setter 124*c*. The first data setter 121*a* of the first head print controller 121 sets the first dot group with regard to an ink ejected from the first ink head 40 (cyan ink herein). The second data setter 121*b* of the first head print controller 121 sets the second dot group with regard to the ink ejected from the first ink head 40. The third data setter 121*c* of the first head print controller 121 sets the third dot group with regard to the ink ejected from the first ink head 40. The first to the third head data setters of the second head data setter 122 to the fourth head data setter 124 also set the dot groups likewise.

A data input interface 130 according to the present preferred embodiment is also configured or programmed in a like manner. The data input interface 130 includes a first head data input interface 131, a second head data input interface 132, a third head data input interface 133, and a fourth head data input interface 134. The first head data input interface 131 includes a first data input interface 131*a*, a second data input interface 131*b*, and a third data input interface 131*c*. The second head data input interface 132 includes a first data input interface 132*a*, a second data input interface 132*b*, and a third data input interface 132*c*. The third head data input interface 133 includes a first data input interface 133*a*, a second data input interface 133*b*, and a third data input interface 133*c*. The fourth head data input interface 134 includes a first data input interface 134*a*, a second data input interface 134*b*, and a third data input interface 134*c*.

FIG. 11 is a schematic view illustrating an example of an operation panel screen according to the present preferred embodiment. The operation panel screen shown in FIG. 11 includes a condition table Tb. The condition table Tb includes 12 input boxes Bx. The 12 boxes of input boxes Bx correspond to a total of 12 data input interfaces; the first to the third data input interfaces 131*a* to 131*c* of the first head data input interface 131, the first to the third data input interfaces 132*a* to 132*c* of the second head data input interface 132, the first to the third data input interfaces 133*a* to 133*c* of the third head data input interface 133, and the first to the third data input interfaces 134*a* to 134*c* of the fourth head data input interface 134. In each of the 12 input boxes Bx, a print coverage is input. In the example shown in FIG. 11, the input boxes Bx for the first ink head 40 are lined up vertically at the left end of the condition table Tb. Next to the right of the input boxes Bx for the first ink head 40, the input boxes Bx for the second ink head 50 are lined up. Further next to the right of the input boxes Bx for the second ink head 50, the input boxes Bx for the third ink head 60 are lined up. At the right end of the condition table Tb, the input boxes Bx for the fourth ink head 70 are lined up.

In addition, at the top end of the condition table Tb, the input boxes Bx for the first print coverage (first dot group) are lined up horizontally. Directly below the input boxes Bx for the first print coverage, the input boxes Bx for the second print coverage are lined up. Further, directly below the input boxes Bx for the second print coverage, the input boxes Bx for the third print coverage are lined up.

When the operator inputs print coverages in the condition table Tb, the condition table Tb is read as a matrix. For example, an input box Bx that is the third one from the left and the second one from the top of the condition table Tb accepts an input of the second print coverage for the third ink head 60 (which ejects yellow ink herein). This input box Bx corresponds to the second data input interface 133*b* of the third head data input interface 133.

As illustrated in FIG. 11, the 12 input boxes Bx in the condition table Tb are able to accept inputs of different print coverages separately. The input boxes Bx are also configured to accept different cumulative print coverages for different ink heads. In the example shown in FIG. 11, the cumulative print coverage for the first ink head 40 (which ejects cyan ink herein) is about 120%, for example. The cumulative print coverage for the second ink head 50 (which ejects magenta ink) is about 130%, for example. The cumulative print coverage for the third ink head 60 (which ejects yellow ink) is about 140%, for example. The cumulative print coverage for the fourth ink head 70 (which ejects black ink) is about 150%, for example.

As described above, the printer 10 according to the present preferred embodiment makes it possible to set different print coverages for different ink colors independently, and accordingly increases freedom in controlling drying conditions of ink. The printer 10 according to the present preferred embodiment is effective when, for example, it uses an ink that is more difficult to dry in comparison with other inks. Moreover, the printer 10 according to the present preferred embodiment is able to print an image with a different color balance from the color balance of the image data. For example, when the recording medium 5 is colored paper, a problem may arise that the color tone of the actual printed image results in a different one from that of the image data. In such a circumstance, the printer 10 according to the present preferred embodiment makes it possible to adjust color tones taking the printed results into consideration.

The present preferred embodiment is one in which the above-described features are added to the first present preferred embodiment. However, it is also possible that the above-described features may be added to the second preferred embodiment. This further increases freedom in control operations.

Hereinabove, preferred embodiments of the present invention have been described. It should be noted, however, that the foregoing preferred embodiments are merely exemplary and the present invention may be embodied in various other forms.

For example, although the controller 100 preferably is configured or programmed to include the data input interface 130 in the foregoing preferred embodiments, a preferred embodiment that does not include the data input interface 130 is also possible. When this is the case, it is possible that the print coverages for the dot groups may be fixed, automatically calculated, or contained in the image data in advance, for example.

In the foregoing preferred embodiments, each of the nozzle arrays preferably is divided into a plurality of partial nozzle arrays allocated along the sub-scanning direction X, and the ink dots of different dot groups are formed by the inks ejected from the nozzles of the plurality of partial nozzle arrays. However, the method of ejecting ink is not limited to the above-described manner. For example, each of the nozzle arrays may not be divided into partial nozzle arrays, but only the ink ejection may be divided into a plurality of times.

In the foregoing preferred embodiments, the dot groups preferably are complementary to each other, and in the end, all the ink dots are formed at least one time. For example, the "second dot group" is extracted preferentially from the ink dots that have not been extracted as the "first dot group". However, it is possible that not all of the ink dots need to be formed at least one time. For example, when the "first dot group" is randomly extracted from the entire ink dot aggregate at a print coverage of about 90% and the "second dot group" is also randomly extracted from the entire ink dot aggregate at a print coverage of about 90%, about 1% of the ink dots remain unprinted in terms of probability. Nevertheless, the technology disclosed herein may be implemented in such a preferred embodiment.

In the foregoing preferred embodiments, a plurality of colors of inks are preferably ejected from different ink heads, but this is not always the case. It is possible that a single ink head may include a plurality of nozzle arrays so that the single ink head can eject a plurality of colors of inks. The "ink head" disclosed herein also includes such an ink head.

In the foregoing preferred embodiments, the drying device that dries the ink on the recording medium 5 preferably is the heater 35 disposed below the platen 12. However, the drying device is not limited thereto. The drying device may also include, for example, a remote heating system such as an infrared irradiation device or a halogen heater. Moreover, even when the drying device is a heater, the heater is not limited to one that heats the platen 12. Furthermore, the drying device may also be provided with a pre-heater and/or a post-heater.

In the foregoing preferred embodiments, the inkjet system that ejects ink preferably is a piezo-electric system. However, the inkjet system of the printers according to preferred embodiments of the present invention may be selected from various types of inkjet systems, including various continuous inkjet systems such as binary deflection inkjet system and a continuous deflection inkjet system, and various on-demand inkjet systems such as a thermal inkjet system. The inkjet system is not limited to any particular inkjet system.

In the foregoing preferred embodiments, the carriage 25 preferably moves along the main scanning direction Y and the recording medium 5 moves along the sub-scanning direction X, but this is not necessarily required to practice the present invention. The movements of the carriage 25 and the recording medium 5 are relative, so either one of them may move along the main scanning direction Y or along the sub-scanning direction X. For example, it is possible that the recording medium 5 may be placed immovably while the carriage 25 may be allowed to move both along the main scanning direction Y and the sub-scanning direction X. Alternatively, it is possible that both the carriage 25 and the recording medium 5 may be allowed to move both along the main scanning direction Y and the sub-scanning direction X.

Furthermore, the technology disclosed herein may be applied to various types of inkjet printers. In addition to the so-called roll-to-roll inkjet printers as shown in the foregoing preferred embodiments, in which a rolled recording medium 5 is delivered, the technology may also be applied to flat-bed inkjet printers, for example, in a similar manner. Moreover, the printer 10 is not limited to a printer that is to be used alone as an independent printer, but may be a printer that is combined with another apparatus. For example, the printer 10 may be incorporated in another apparatus.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a first ink head including a plurality of first nozzles arrayed along a sub-scanning direction and ejecting a first ink onto a recording medium; and a controller, including an m number of data setters including a first data setter to an m-th data setter, where m is a natural number equal to or greater than 2, and an m number of print controllers including a first print controller to an m-th print controller, the controller controlling the first ink head to form ink dots of the first ink on the recording medium; wherein upon receiving data for the ink dots of the first ink, the first data setter sets a first dot group including some or all of the ink dots of the first ink;

upon receiving the data for the ink dots of the first ink, an n-th data setter sets an n-th dot group including some or all of the ink dots of the first ink, where n is a natural number in a range of from 2 to m;

the first print controller controls the first ink head to form the first dot group on the recording medium;

an n-th print controller controls the first ink head to form the n-th dot group over an (n−1) dot group; and the first to the m-th data setters set the first to the m-th dot groups so that at least some of ink dots belonging to the first to the m-th dot groups overlap each other.

2. The inkjet printer according to claim 1, wherein the first to the m-th data setters set the first to the m-th dot groups so that the ink dots belonging to the first to the m-th dot groups include all the ink dots of the first ink.

3. The inkjet printer according to claim 1, further comprising:

a sub-scanning-direction conveyor that transfers the recording medium in the sub-scanning direction relative to the first ink head; wherein the first ink head includes the m number of nozzle arrays including a first nozzle array to an m-th nozzle array that are arrayed in that order from upstream to downstream along the sub-scanning direction and include an equal number of the first nozzles;

the first print controller causes the first nozzles of the first nozzle array to eject the first ink onto the recording medium, to form the first dot group on the recording medium; and the n-th print controller controls the sub-scanning-direction conveyor to transfer the recording medium toward downstream along the sub-scanning-direction, and after the transferring, causes the first nozzles of an n-th nozzle array to eject the first ink to form the n-th dot group over the (n−1) dot group.

4. The inkjet printer according to claim 3, further comprising:

a second ink head including a plurality of second nozzles arrayed along the sub-scanning direction and ejecting a second ink onto the recording medium; wherein the first ink head and the second ink head are arranged along a main scanning direction orthogonal to the sub-scanning direction;

the controller further includes an m number of additional data setters including a first additional data setter to an m-th additional data setter, and an m number of additional print controllers including a first additional print controller to an m-th additional print controller, the controller controlling the second ink head and the sub-scanning-direction transfer device to form ink dots of the second ink on the recording medium;

upon receiving data for the ink dots of the second ink, the first additional data setter sets a first additional dot group including some or all of the ink dots of the second ink;

upon receiving the data of the ink dots of the second ink, an n-th additional data setter sets an n-th additional dot group including some or all of the ink dots of the second ink;

the first additional print controller controls the second ink head to form the first additional dot group on the recording medium; and an n-th additional print controller controls the second ink head to form the n-th additional dot group over an (n−1) additional dot group.

5. The inkjet printer according to claim 4, wherein the first to the m-th additional data setters set the first to the m-th additional dot groups so that at least some of ink dots belonging to the first to the m-th additional dot groups overlap each other.

6. The inkjet printer according to claim 4, wherein the first to the m-th additional data setters set the first to the m-th additional dot groups so that the ink dots belonging to the first to the m-th dot additional dot groups include all the ink dots of the second ink.

7. The inkjet printer according to claim 4, wherein the second ink head includes an m number of additional nozzle arrays including a first additional nozzle array to an m-th additional nozzle array that are arrayed in that order from upstream to downstream along the sub-scanning direction and include an equal number of the second nozzles;

the first additional nozzle array is aligned with the first nozzle array with respect to the sub-scanning direction;

an n-th additional nozzle array is aligned with the n-th nozzle array with respect to the sub-scanning direction;

the first additional print controller causes the second nozzles of the first additional nozzle array to eject the second ink onto the recording medium, to form the first additional dot group on the recording medium; and the n-th additional print controller controls the sub-scanning-direction transfer device to transfer the recording medium toward downstream along the sub-scanning-direction, and after the transferring, causes the second nozzles of an n-th additional nozzle array to eject the second ink to form the n-th additional dot group over the (n−1) additional dot group.

8. The inkjet printer according to claim 4, wherein the first additional data setter extracts the first additional dot group from all the ink dots of the second ink using a first additional mask having a first additional decimation rate; and the n-th additional data setter extracts the n-th additional dot group from all the ink dots of the second ink using an n-th additional mask having an n-th additional decimation rate.

9. The inkjet printer according to claim 8, wherein the controller further includes:

a first additional data input interface that accepts an input of the first additional decimation rate; and an n-th additional data input interface that accepts an input of the n-th additional decimation rate.

10. The inkjet printer according to claim 1, wherein the first data setter extracts the first dot group from all the ink dots of the first ink using a first mask having a first decimation rate; and the n-th data setter extracts the n-th dot group from all the ink dots of the first ink using an n-th mask having an n-th decimation rate.

11. The inkjet printer according to claim 10, wherein the controller further includes:

a first data input interface that accepts an input of the first decimation rate; and an n-th data input interface that accepts an input of the n-th decimation rate.

12. The inkjet printer according to claim 1, wherein the second data setter sets a second dot group so that the second dot group includes a smaller number of ink dots than the first dot group.

13. The inkjet printer according to claim 12, wherein the number m is a natural number greater than or equal to 3; and the third data setter sets a third dot group so that the third dot group contains a larger number of ink dots than the second dot group and that the third dot group contains a smaller number of ink dots than the first dot group.

14. The inkjet printer according to claim 1, further comprising a dryer that dries the ink ejected on the recording medium.

* * * * *